US006531996B1

(12) United States Patent
Murade

(10) Patent No.: US 6,531,996 B1
(45) Date of Patent: Mar. 11, 2003

(54) ELECTRO-OPTICAL APPARATUS AND ELECTRONIC APPARATUS

(75) Inventor: Masao Murade, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/227,897

(22) Filed: Jan. 11, 1999

(30) Foreign Application Priority Data

Jan. 9, 1998 (JP) ..... 10-015150

(51) Int. Cl.[7] ..... G09G 3/36

(52) U.S. Cl. ..... 345/98; 345/100; 345/87; 345/92

(58) Field of Search ..... 345/98, 100, 87, 345/92

(56) References Cited

U.S. PATENT DOCUMENTS 5,686,936 A * 11/1997 Maekawa et al. ..... 345/100
5,708,454 A * 1/1998 Katoh et al. ..... 345/100
5,764,207 A * 6/1998 Maekawa et al. ..... 345/99
5,801,673 A * 9/1998 Shimada et al. ..... 345/109
5,959,600 A * 9/1999 Uchino et al. ..... 345/94
6,037,923 A * 3/2000 Suzuki ..... 345/92
6,072,457 A * 6/2000 Hashimoto et al. ..... 345/100

FOREIGN PATENT DOCUMENTS

JP 7-295520 11/1995

* cited by examiner

*Primary Examiner*—Steven Saras
*Assistant Examiner*—Fritz Alphonse
(74) *Attorney, Agent, or Firm*—Oliff & Berridge, PLC.

(57) ABSTRACT

An electro-optical apparatus is capable of displaying an high-quality image including no non-uniformity in contrast even when the scanning direction is inverted. A precharging circuit driving signal line and a precharging signal line are formed on a TFT array substrate such that they extend around a data line driving circuit and a pixel area and such that these signal lines are connected to a precharging circuit from two sides of the precharging circuit. Signal supplying contacts for making connection to external signal sources are also formed on the substrate. Two ends of the precharging circuit driving signal line are connected to signal supplying contacts and, respectively, and two ends of the precharging signal line are connected to the other signal supplying contacts, respectively, so that the precharging circuit driving signal and the precharging signal are supplied from two sides.

21 Claims, 21 Drawing Sheets

SCANNING DIRECTION IS INVERTED BY LIQUID CRYSTAL PANELS

SCANNING DIRECTION IS INVERTED BY EXTERNAL MEMORY

ELECTRO-OPTICAL APPARATUS AND ELECTRONIC APPARATUS

BACKGROUND OF THE INVENTION

1. Field of Invention

The present invention relates to an electro-optical-apparatus such as an active matrix type liquid crystal device which is driven by thin-film transistors (hereinafter referred to as TFTs) and to an electronic apparatus using such an electro-optical apparatus. More particularly, the present invention relates to an electro-optical apparatus including at least one of a sampling circuit and a precharging circuit formed on a TFT array substrate and to an electronic apparatus using such an electro-optical apparatus.

2. Description of Related Art

In a conventional active matrix liquid crystal device driven by TFTs, a great number of scanning lines and data lines are disposed on a TFT array substrate in such a manner that they extend in vertical and horizontal directions, respectively, and a great number of pixel electrodes are disposed on the TFT array substrate at intersections of the scanning and data lines. In some cases, in addition to the above elements, various peripheral circuits composed of TFTs, such as a sampling circuit, a precharging circuit, a scanning line driving circuit, and a data line driving circuit, are also formed on the TFT array substrate.

Of these peripheral circuits, the sampling circuit serves to sample an image signal and output, in sychronization with a scanning signal, sampled image signal at a high frequency over respective data lines.

The precharging circuit supplies a precharging signal (auxiliary image signal) over the data lines before the image signal is supplied from the data line driving circuit via the sampling circuit or directly over the data lines so as to improve the contrast, stabilize the voltage level on the data lines, and improve the line-to-line uniformity in intensity of the image displayed on the screen. That is, the precharging circuit facilitates writing a high-quality image signal on the data lines. In particular, when the polarity of the voltage applied on the data lines is inverted at a predetermined frequency so as to drive a liquid crystal in an AC mode, as is the case with the so-called 1H inverting driving technique, it is possible to greatly reduce the charge required to write an image signal on the data lines if a precharging signal is written on the data lines before the image signal is written on the data lines. A specific example of a precharging circuit is disclosed for example in Japanese Unexamined Patent Publication No. 7-295520.

As described above, if peripheral circuits such as a sampling circuit and a precharging circuit are formed on the TFT array substrate, it becomes possible to display a high-quality image and it is also possible to reduce the load exerted on the hardware resource such as a driving circuit.

However, when the TFTs of the precharging circuit or the sampling circuit are turned on, the precharging signal line or the image signal line used to transmit the precharging signal or the image signal is connected, via TFTs of the precharging circuit or the sampling circuit, to a great number of data lines having an extremely large interconnection capacitance. Besides, because the precharging signal or the image signal is supplied only from one end of the precharging signal line or the image signal line, the signal propagation delay increases with the location along the precharging signal line or the image signal line toward the opposite end.

According to the conventional technique, the precharging signal line or the image signal line are formed in such a manner that they extend over the TFT array substrate, starting at a contact connected to an external terminal on the TFT array substrate, in a direction parallel to the great number of data lines and generally perpendicular to the direction in which the scanning line extends, for example, from left to right, wherein the end of the precharging signal line or the image signal line is connected to a TFT, and connected to a data line at the extreme right of the precharging circuit or the sampling circuit. In particular, in the case where a precharging signal is supplied at the same time to a great number of data lines, or in the case where phase expansion is employed and thus an image signal is supplied at the same time to a great number of data lines, the great number of data lines are connected to the precharging signal line or the image signal line via TFTs of the precharging circuit or the sampling circuit. As a result, the increase in the interconnection capacitance becomes greater with the location along the precharging signal line or the image signal line toward its end.

Therefore, the precharging signal or the image signal supplied from the external terminal has a propagation delay which increases along the precharging signal line or the image signal line toward its end, and the charge written on the data lines in accordance with the precharging signal or the image signal varies depending on the location of the data lines from left to right. As a result, the contrast becomes different between the left and right portions of the image displaying area.

In particular, in the case of a liquid crystal device having a great number of pixels arranged at small intervals to display a high-precision image, a greater number of data lines are required and thus the circuit is required to supply a precharging signal to a greater load. As a result, the propagation delay and the associated degradation become greater.

The variation in the contrast is not so serious when only a single liquid crystal device is used. However, when two or three liquid crystal devices are combined and only one of them is inverted in the scanning direction of the data line driving circuit as is the case in a multipanel liquid crystal projector, one liquid crystal device has a variation in contrast in the opposite direction to that of the other liquid crystal devices and thus perceptible non-uniformity in color occurs.

SUMMARY OF THE INVENTION

In view of the above, it is an object of the present invention to provide a liquid crystal device capable of displaying a high-quality image including no non-uniformity in contrast or color even when the scanning direction is inverted. It is another object of the invention to provide an electronic apparatus including such a liquid crystal device.

As described above, the present invention provides an electro-optical apparatus in which at least either an image signal line or a precharging signal line extends on a substrate such that at least either the image signal line or the precharging signal line is connected to the sampling circuit or the precharging circuit from two sides of an arrangement of a plurality of data lines along a direction in which data lines are arranged side by side thereby preventing non-uniformity in contrast. A plurality of electro-optical apparatus can be employed as liquid crystal devices to realize a liquid crystal projector capable of displaying a high-quality image including no non-uniformity in color.

To achieve the above objects, according to an aspect of the invention, there is provided an electro-optical apparatus including a plurality of data lines for supplying an image signal, a plurality of scanning lines for supplying a scanning signal, first switching means connected to the respective data lines and the respective scanning lines, and pixel electrodes connected to the corresponding first switching means, the electro-optical apparatus comprising:

a sampling circuit including second switching means for sampling the image signal supplied to an image signal line and supplying the resultant signal to the data lines; and a precharging circuit including third switching means for supplying a precharging signal supplied to a precharging signal line, to the data lines, according to a driving signal supplied from a precharging circuit driving signal line, before a sampling period in which the image signal is supplied to the data lines;

the precharging signal line extending over the substrate along the direction in which the data lines are arranged side by side so as to be connected to said precharging circuit from two sides of the plurality of data lines.

In the electro-optical apparatus when the third switching means is turned on, the precharging signal is supplied from the precharging circuit to the plurality of data lines before the image signal is supplied so that the respective data lines are precharge by the precharging signal thereby allowing the pixel electrodes to be. driven by the image signal with a less amount of charge which is subsequently supplied via the data lines, than would be required if the data lines were not precharged. In particular in a driving mode in which the image signal is supplied to the respective pixels while inverting the polarity of the image signal for example every horizontal scanning period, the precharging can result in a great reduction in the charge required to drive the pixels by the image signal. After that, the first switching means control the electrical conduction or isolation between the data lines and the corresponding pixel electrodes (for example between the source and drain) in response to the scanning signal applied to the gate electrodes of the respective first switching means. For example, if, in response to a scanning signal, a first switching means provides an electrical conduction between a data line and a pixel electrode, then an image signal supplied from the sampling circuit is written into that pixel electrode via the data line. As a result, the orientation of the electro-optical material such as liquid crystal in the corresponding part changes depending on the voltage applied to the pixel electrode. Similarly, upon the supply of the precharging signal, the image signal to the plurality of data lines and supply of the scanning signal to the plurality of scanning lines, the voltages are supplied to the respective pixel electrodes in a line-sequential fashion or a dot-sequential fashion so that an image is formed in the image display area consisting of the plurality of pixel electrodes of the electro-optical apparatus as a result of the change in the distribution of the orientation of the electro-optical material in response to the image signal.

In this electro-optical apparatus, the precharging signal line for transmitting the precharging signal extends over the substrate in such a manner that it is connected to the precharging circuit from two sides of the plurality of data lines along the direction in which the data lines are arranged side by side.

In the present apparatus, even in a situation where a great interconnection capacitance is added to the precharging signal line as a result of the turning on of the third switching means and thus a delay can occur in the propagation from one side toward the opposite side in the direction in which the data lines are arranged side by side, the precharging signal is written on all data lines without having a delay because the same signal is also supplied form the opposite side.

Thus, each electro-optical device such as each electro-optical apparatus device does not have non-uniformity in contrast. Therefore, when a plurality of electro-optical apparatus are combined, the resultant mixed image does not have non-uniformity in color.

According to another aspect of the present invention, there is provided an electro-optical apparatus in which said precharging signal lines are connected to different signal supplying contacts.

In this electro-optical apparatus one end of the precharging signal line connected to the precharging circuit from one side of the data lines is connected to one signal supplying contact disposed on the substrate at one side of the data lines and the other end of the precharging signal line connected to the precharging circuit from the opposite side of the data lines is connected to the other signal supplying contact disposed at the opposite side of data lines. When a precharging signal is supplied from an external signal source to the respective signal supplying contacts, the precharging signal is transmitted through the precharging signal line connected to the precharging circuit from two sides of the data lines along the direction in which the data lines are arranged side by side, and thus the precharging signal is supplied to the precharging circuit from two sides. If the pixel size is reduced and/or the number of data lines and third switching means is increased, there will be a large interconnection capacitance added to the precharging signal line or there will be a large overall on-resistance associated with the third switching means. Such an increase in the interconnection capacitance or the on-resistance can normally cause a propagation delay associated with a signal transmitted through the precharging signal line from one side of the arrangement of data lines toward the opposite side. However, in the present electro-optical apparatus, the same signal is supplied also from the opposite side via the signal supplying contact, and thus the precharging signal is written on all data lines without having delay. As a result, all data lines are uniformly precharged to the same desired voltage, which allows the image signal to be written in a desirable fashion without producing non-uniformity in contrast.

According to another aspect of the present invention, there is provided an electro-optical apparatus in which the precharging signal lines are formed of a metal film or a metal alloy film having a low resistance similar to that of the data lines and formed by the same process as which the data lines are formed.

In the electro-optical apparatus, the data lines are formed of a metal film or a metal alloy film having a low resistance and the precharging signal line is also formed of a metal film or a metal alloy film having a low resistance similar to that of the data lines and in the same process in which the data lines are formed. This allows the electro-optical apparatus to be produced rather easily without needing an additional process even in the case where the precharging signal line extends such that the precharging signal line is connected to the precharging circuit from two sides.

According to still another aspect of the present invention, there is provided an electro-optical apparatus in which the precharging circuit driving signal lines extend over the substrate along the direction in which the data lines are arranged side by side so that the precharging circuit driving signal lines are connected to said precharging circuit from two sides of the arrangement area of the plurality of data lines.

In this electro-optical apparatus, the precharging circuit driving signal line extends over the substrate in such a manner that it is connected to the precharging circuit from two sides of the plurality of data lines along the direction in which the data lines are arranged side by side.

In the present apparatus, even in a situation where a great interconnection capacitance is added to the precharging circuit driving signal line as a result of the turning on of the third switching means and thus a delay can occur in the propagation from one side toward the opposite side in the direction in which the data lines are arranged side by side, the precharging signal is written on all data lines without having a delay because the same signal is also supplied form the opposite side.

Thus, each electro-optical apparatus does not have non-uniformity in contrast. Therefore, when a plurality of electro-optical apparatus are combined, the resultant mixed image does not have non-uniformity in color.

According to another aspect of the present invention, there is provided an electro-optical apparatus including a plurality of data lines for supplying an image signal, a plurality of scanning lines for supplying a scanning signal, first switching means connected to the respective data line and the respective scanning lines, and pixel electrodes connected to said corresponding first switching means, said plurality of data lines, said plurality of scanning lines, said first switching means, and said pixel electrodes being all formed on a substrate, said electro-optical apparatus comprising:

a sampling circuit including second switching means for sampling said image signal supplied to an image signal line and supplying the resultant signal to said data lines; and a precharging circuit including third switching means for supplying a precharging signal, supplied to precharging signal lines, to said data lines according to a driving signal supplied from a precharging circuit driving signal line, before a sampling period in which said image signal is supplied to said data lines, said precharging circuit driving signal lines extending over said substrate along the direction in which the data lines are arranged side by side so that the precharging circuit driving signal lines are connected to said precharging circuit from two sides of the plurality of data lines.

In the electro-optical apparatus when the third switching means is turned on, the precharging signal is supplied from the precharging circuit to the plurality of data lines before the image signal is supplied so that the respective data lines are precharged by the precharging signal thereby allowing the pixel electrodes to be driven by the image signal with a less amount of charge which is subsequently supplied via the data lines, than would be required if the data lines were not precharged. In particular in a driving mode in which the image signal is supplied to the respective pixels while inverting the polarity of the image signal for example every horizontal scanning period, the precharging can result in a great reduction in the charge required to drive the pixels by the image signal. After that, the first switching means control the electrical conduction or isolation between the data lines and the corresponding pixel electrodes (for example between the source and drain) in response to the scanning signal applied to the gate electrodes of the respective first switching means. For example, if, in response to a scanning signal, a first switching means provides an electrical conduction between a data line and a pixel electrode, then an image signal supplied from the sampling circuit is written into that pixel electrode via the data line. As a result, the orientation of the electro-optical material in the corresponding part changes depending on the voltage applied to the pixel electrode. Similarly, upon the supply of the precharging signal and the image signal to the data lines and the supply of the scanning signal to the scanning lines, the voltages are applied to the pixel electrodes, in a line-sequential fashion or a dot-sequential fashion so that an image is formed in the image display area consisting of the plurality of pixel electrodes of the electro-optical apparatus as a result of the change in the distribution of the orientation of the electro-optical material in response to the image signal.

In this electro-optical apparatus, the precharging circuit driving signal line extends over the substrate in such a manner that it is connected to the precharging circuit from two sides of the plurality of data lines along the direction in which the data lines are arranged side by side.

In the present apparatus, even in a situation where a great interconnection capacitance is added to the precharging circuit driving signal line as a result of the turning on of the third switching means and thus a delay can occur in the propagation from one side toward the opposite side in the direction in which the data lines are arranged side by side, the precharging signal is written on all data lines according to the driving signal supplied from the precharging circuit driving signal line without having a delay because the same signal is also supplied form the opposite side.

Thus, each electro-optical apparatus does not have non-uniformity in contrast. Therefore, when a plurality of electro-optical apparatus are combined, the resultant mixed image does not have non-uniformity in color.

According to another aspect of the present invention, there is provided an electro-optical apparatus in which said precharging circuit driving signal lines are connected to different signal supplying contacts formed at two sides of said arrangement area of data lines relative to the direction in which the data lines are arranged side by side).

In this electro-optical apparatus one end of the precharging circuit driving signal line connected to the precharging circuit from one side of the data lines is connected to one signal supplying contact disposed on the substrate at one side of the data lines and the other end of the precharging circuit driving signal line connected to the precharging circuit from the opposite side of the data lines is connected to the other signal supplying contact disposed at the opposite side of the arrangement of data lines. When a precharging circuit driving signal is supplied from an external signal source to the respective signal supplying contacts, the precharging circuit driving signal is transmitted through the precharging circuit driving signal line connected to the precharging circuit from two sides of the data lines along the direction in which the data lines are arranged side by side, and thus the precharging circuit driving signal is supplied to the precharging circuit from two sides. If the pixel size is reduced and/or the number of data lines and third switching means is increased, there will be a large interconnection capacitance added to the precharging circuit driving signal line or there will be a large overall on-resistance associated with the third switching means. Such an increase in the interconnection capacitance or the on-resistance can normally cause a propagation delay associated with a signal transmitted through the precharging circuit driving signal line from one side of the arrangement of data lines toward the opposite side. However, in the present electro-optical apparatus, the same signal is supplied also from the opposite side via the signal supplying contact, and thus the precharging circuit driving signal is written to the third switching means on all data lines without having delay. As a result, all data lines are uniformly precharged to the same desired voltage, which allows the image signal to be written in a desirable fashion without producing non-uniformity in contrast.

According to another aspect of the present invention , there is provided an electro-optical apparatus in which the precharging circuit driving signal lines are formed of a metal film or a metal alloy film having a low resistance similar to that of the data lines and formed by the same process as which the data lines are formed.

In the electro-optical apparatus, the data lines are formed of a metal film or a metal alloy film having a low resistance and the precharging circuit driving signal line is also formed of a metal film or a metal alloy film having a low resistance similar to that of the data lines and in the same process in which the data lines are formed. This allows the electro-optical apparatus to be produced rather easily without needing an additional process even in the case where the precharging circuit driving signal line extends such that the precharging circuit driving signal line is connected to the precharging circuit from two sides.

According to still another aspect of the present invention, there is provided an electro-optical apparatus further including a data line driving circuit including a bidirectional shift register, the data line driving circuit serving to successively drive the second switching means of the sampling circuit in the same or opposite direction as to the direction in which the data lines are arranged side by side.

In the electro-optical apparatus the second switching means of the sampling circuit are line-sequentially turned on by the driving signal successively output from the data line driving circuit so that the image signal is written on the data lines line by line. By means of the bidirectional shift register provided in the data line driving circuit, the driving signal is transferred from one side to the opposite side or from the opposite side to the one side in the direction in which the data lines are arranged side by side. This means that the order in which transistors of the second switching means are turned on changes depending on the transfer direction of the driving signal. Because the image signal is supplied to the sampling circuit from two sides of data lines along the direction in which data lines are arranged side by side, the image signal is written on the data lines in a similar manner regardless of the transfer direction. Therefore, non-uniformity in contrast does not occur even when the image is displayed in an inverted fashion.

According to still another aspect of the present invention, there is provided an electro-optical apparatus in which the precharging circuit is disposed together with a data line driving circuit including a shift register and the sampling circuit at a same side of the data lines and the precharging circuit driving signal line is supplied with a precharging circuit driving signal to successively turn on the transistors of the third switching means thereby successively driving the data lines line by line before the second switching means are turned on.

In the electro-optical apparatus because the precharging circuit is disposed together with the data line driving circuit and the sampling circuit at the same side of the data lines, the non-pixel area can be used in a highly efficient manner and thus an electro-optical apparatus with a reduced size can be realized for example by connecting the sampling circuit and the precharging circuit in parallel or by supplying respective driving signals to both the sampling circuit and the precharging circuit from the data line driving circuit. When the respective driving signals are supplied from a common circuit as described above, it is still required to write the precharging signal on the data lines before the image signal is written. To this end, the precharging circuit driving signal is supplied to the precharging circuit driving signal line for transmitting the driving signal to the third switching means to turn on the third switching means thereby line-sequentially turning on the data lines before the second switching means are turned on. This ensures that the third switching means of the precharging circuit are turned on before the second switching means of the sampling circuit are turned on and thus the precharging signal is properly written on the data lines. In this case, the order in which the precharging signal is written on the data lines changes depending on the transfer direction of the data line driving circuit. However, as described above, because the precharging signal is supplied from two sides of the precharging circuit, the precharging signal is written on the data lines in a similar manner without producing non-uniformity in contrast regardless of the transfer direction.

According to still another aspect of the present invention, there is provided an electro-optical apparatus wherein the data line driving circuit includes: a second bidirectional shift register for successively driving the third switching means of the precharging circuit in the same or opposite direction as to the direction in which the data lines are arranged side by side.

In the electro-optical apparatus, in response to the driving signal which is output from the data line driving circuit and successively transferred in the same or opposite direction as or to the direction in which data lines are arranged side by side, transistors of the second switching means of the sampling circuit are successively turned on thereby successively driving the data lines line by line or from one group of lines to another. Similarly, in response to the driving signal which is output from the data line driving circuit and successively transferred in the same or opposite direction as to the direction in which data lines are arranged side by side, transistors of the third switching means of the precharging circuit are successively turned on thereby successively driving the data lines line by line. Thus, the order in which the precharging signal is written on the data lines changes depending on the transfer direction of the driving signal. However, the precharging signal is written on the data lines in a similar manner regardless of the transfer direction because the precharging signal is supplied to the precharging circuit from two sides along the direction in which data lines are arranged side by side. Therefore, precharging is performed in a desirable fashion without producing non-uniformity in contrast even when the image is displayed in an inverted fashion.

According to still another aspect of the present invention, there is provided an electro-optical apparatus, the precharging circuit being disposed on an opposite side of the data lines from the side where the data line driving circuit and the sampling circuit are disposed and the precharging circuit driving signal line transmitting a driving signal to the third switching means of the precharging circuit supplied with a precharging circuit driving signal to turn on all of the plurality of transistors of the transistors of the third switching means at the same time in a horizontal blanking period.

In the electro-optical apparatus, because the precharging circuit is disposed on the opposite side of the data lines from the side where the data line driving circuit and the sampling circuit are disposed, the non-pixel area of the electro-optical apparatus is used in a highly efficient manner and thus it is possible to reduce the size of the electro-optical apparatus.

When the precharging circuit is disposed in the above-described manner, it becomes difficult to use the signal line-sequentially output from the data line driving circuit. To avoid the above problem, the precharging circuit driving signal is supplied to the precharging circuit through the precharging circuit driving signal line connected to the precharging circuit from two sides along the direction in which data lines are arranged side by side thereby turning on all transistors of the third switching means of the precharging circuit at the same time in the horizontal blanking period. As a result, the interconnection capacitance associated with all data lines is added to the precharging circuit driving signal line. However, because the precharging circuit driving signal line is connected to the precharging circuit from two sides as described above, the precharging circuit driving signal is supplied to the third switching means from two sides. Therefore, even in a situation where a signal propagation delay can occur from one side of the data line toward the opposite side, the precharging signal is written on all data lines according to the driving signal of the precharging circuit driving signal in substantially the same manner without producing non-uniformity in contrast because the precharging signal is also supplied from the opposite side toward the above-described one side.

According to still another aspect of the present invention, there is provided an electro-optical apparatus in which said image signal lines extend over said substrate along the direction in which the data lines are arranged side by side so that the image signal lines are connected to said sampling circuit from two sides of the plurality of data lines.

In the present apparatus, even in a situation where a great interconnection capacitance is added to the image signal line as a result of the turning on of the second switching means and thus a delay can occur in the propagation from one side toward the opposite side in the direction in which the data lines are arranged side by side, the image signal is written on all data lines without having a delay because the same signal is also supplied form the opposite side.

Thus, each electro-optical apparatus does not have non-uniformity in contrast. Therefore, when a plurality of electro-optical apparatus are combined, the resultant mixed image does not have non-uniformity in color.

According to another aspect of the present invention, there is provided an electro-optical apparatus including a plurality of data lines for supplying an image signal, a plurality of scanning lines for supplying a scanning signal, first switching means connected to the respective data line and the respective scanning lines, and pixel electrodes connected to said corresponding first switching means, said plurality of data lines, said plurality of scanning lines, said first switching means, and said pixel electrodes being all formed on a substrate, said electro-optical apparatus comprising:

a sampling circuit including second switching means for sampling said image signal supplied to an image signal line and supplying the resultant signal to said data lines, said image signal lines extending over said substrate along the direction in which the data lines are arranged side by side so as to be connected to said sampling circuit from two sides of the arrangement area of the plurality of data line.

In this electro-optical apparatus, the image signal line extends over the substrate in such a manner that it is connected to the sampling circuit from two sides of the plurality of data lines along the direction in which the data lines are arranged side by side.

In the present apparatus, even in a situation where a great interconnection capacitance is added to the image signal line as a result of the turning on of the second switching means and thus a delay can occur in the propagation from one side toward the opposite side in the direction in which the data lines are arranged side by side, the image signal is written on all data lines without having a delay because the same signal is also supplied form the opposite side.

Thus, each electro-optical apparatus does not have non-uniformity in contrast. Therefore, when a plurality of electro-optical apparatus are combined, the resultant mixed image does not have non-uniformity in color.

According to still another aspect of the present invention, there is provided an electro-optical apparatus, in which said image signal lines are connected to different signal supplying contacts.

In this electro-optical apparatus, one end of the image signal line is connected to one signal supplying contact disposed on the substrate at one side of the data lines and the other end of the image signal line connected to the sampling circuit is connected to the other signal supplying contact disposed at the opposite side of the arrangement of data lines. When a image signal is supplied from an external signal source to the respective signal supplying contacts, the image signal is transmitted through the image signal line connected to the sampling circuit from two sides of the data lines along the direction in which the data lines are arranged side by side, and thus the image signal is supplied to the sampling circuit from two sides. If the pixel size is reduced and/or the number of data lines and second switching means is increased, there will be a large interconnection capacitance added to the image signal line or there will be a large overall on-resistance associated with the third switching means. Such an increase in the interconnection capacitance or the on-resistance can normally cause a propagation delay associated with a signal transmitted through the image signal line from one side of the arrangement of data lines toward the opposite side. However, in the present electro-optical apparatus, the same signal is supplied also from the opposite side via the signal supplying contact, and thus the image signal is written on all data lines without having delay. As a result, all data lines are uniformly supplied to the same desired voltage, which allows the image signal to be written in a desirable fashion without producing non-uniformity in contrast.

According to still another aspect of the present invention, there is provided an electro-optical apparatus in which a data line driving circuit includes a bidirectional shift register for successively driving said second switching means of the sampling circuit in the same or opposite direction as to the direction in which the data lines are arranged side by side.

In the electro-optical apparatus the second switching means of the sampling circuit are line-sequentially turned on by the driving signal successively output from the data line driving circuit so that the image signal is written on the data lines line by line. By means of the bidirectional shift register provided in the data line driving circuit, the driving signal is transferred from one side to the opposite side or from the opposite side to the one side in the direction in which the data lines are arranged side by side. This means that the order in which transistors of the second switching means are turned on changes depending on the transfer direction of the driving signal. Because the image signal is supplied to the sampling circuit from two sides of data lines along the direction in which data lines are arranged side by side, the image signal is written on the data lines in a similar manner regardless of the transfer direction. Therefore, non-uniformity in contrast does not occur even when the image is displayed in an inverted fashion.

According to still another aspect of the present invention, there is provided an electronic apparatus including an electro-optical apparatus according to the above described aspects.

In the electronic apparatus because the electronic apparatus includes an electro-optical apparatus according to the present invention, it is possible to display a high-quality image including no non-uniformity in contrast. When a plurality of electro-optical apparatus are combined to produce a mixed image, it is possible to display a high-quality image including no non-uniformity in contrast using color light sources. That is, it is possible to display a high-precision and high-quality image.

These and other features and advantages of the present invention will become more apparent from the following detailed description referring to preferred embodiments.

DETAILED DESCRIPTION OF PREFERRED EMBODIMENTS

Figure 1:
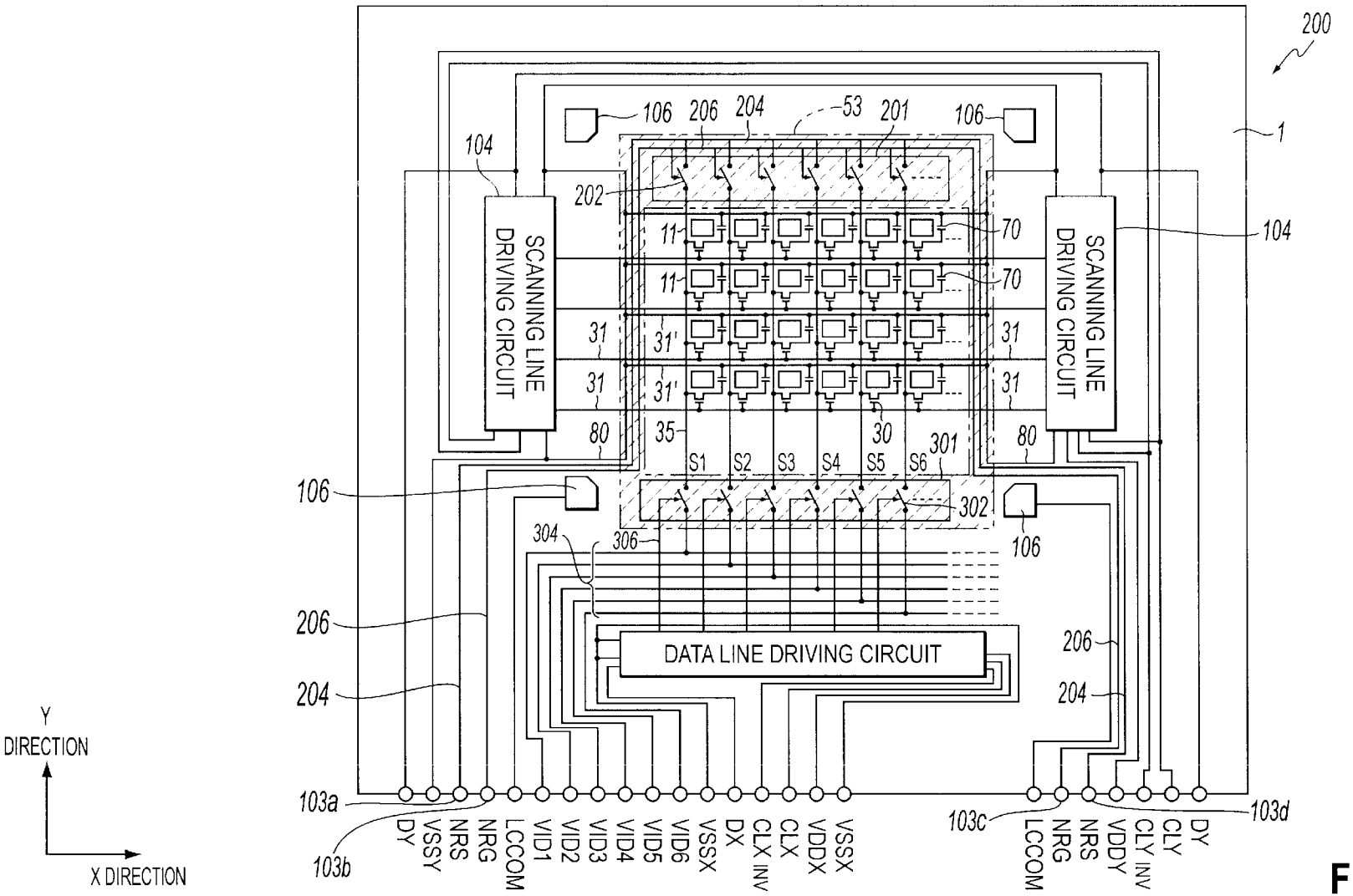
FIG. 1 is a block diagram illustrating a liquid crystal device including various interconnections and peripheral circuits formed on a TFT array substrate, according to an embodiment of the invention.

Referring to the drawings, embodiments of the invention are described below.

Referring to FIGS. 1 to 5, a liquid crystal device, which is an embodiment of an electro-optical apparatus according to the invention, is described below.

Figure 2:
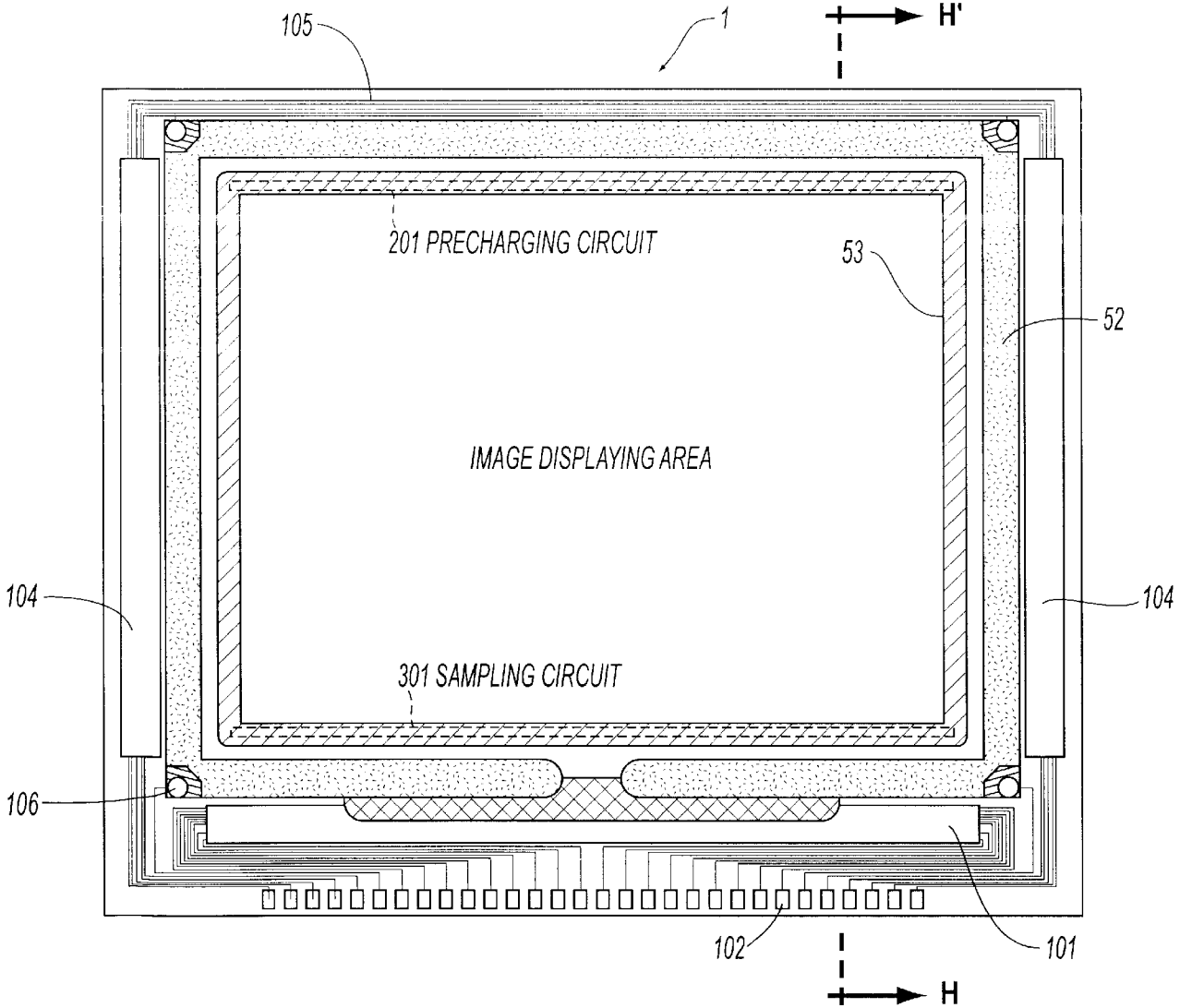
FIG. 2 is a plan view illustrating the general structure of the liquid crystal device shown in FIG. 1.
Figure 3:
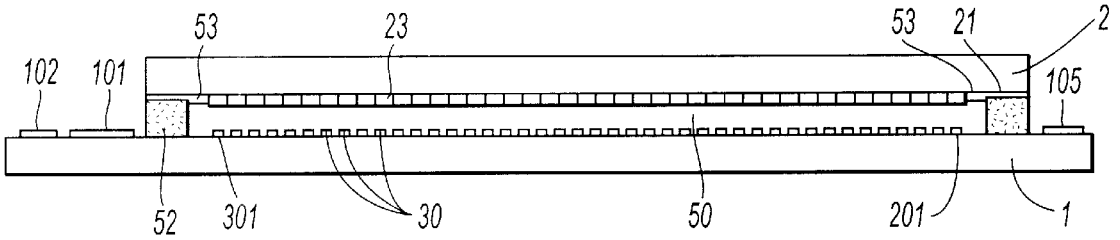
FIG. 3 is a cross-sectional view illustrating the general structure of the liquid crystal device shown in FIG. 1.

Referring first to FIGS. 1 to 3, the general construction of the liquid crystal device is described. FIG. 1 is a block diagram illustrating the liquid crystal device according to the present embodiment of the invention wherein various interconnections and peripheral circuits formed on a TFT array substrate are shown in the figure. FIG. 2 is a plan view seen from the side of an opposite substrate, wherein various elements formed on the TFT array substrate are shown. FIG. 3 is a cross-sectional view taken along line H–H' of FIG. 2, wherein the opposite substrate is also shown.

In FIG. 1, the liquid crystal device 200 includes a TFT array substrate 1 made of for example quartz or hard glass. On the TFT array substrate 1, there are provided a plurality of pixel electrodes 11 disposed in a matrix fashion, a plurality of data lines 35 arranged side by side in an X direction and each extending in a Y direction, a plurality of scanning lines 31 arranged side by side in the Y direction and each extending in the X direction, and a plurality of switching devices such as TFTs 30 disposed between the respective pixel electrodes 11 and the corresponding data lines 35 wherein the plurality of TFTs 30 serve to control the conduction and isolation between the respective pixel electrodes 11 and the corresponding data lines in accordance with the scanning signal supplied via the scanning lines 31. On the TFT array substrate 1, there are also provided capacitor lines 31' extending in a direction substantially parallel to the scanning lines 31 and connected to storage capacitors 70 added to the respective pixel electrodes 11. The capacitance lines 31' may be formed not only in such a manner that they simply extend in the direction parallel to the scanning lines 31 but also in such a manner that the capacitance lines 31' extend below the scanning lines so that storage capacitances are formed between the scanning lines and the capacitance lines. In this embodiment, the capacitor lines 31' are connected to a negative power supply line VSSY via a constant voltage line 80. By using the constant voltage line such as a power voltage line of a peripheral circuit on the TFT array substrate 1 in the above-described manner, it is not required to provide additional external terminal 102 for the connection to the capacitance line 31'. This allows a reduction in the number of external terminals and thus a reduction in the size of the liquid crystal device 200.

On the TFT array substrate 1, there are also provided a precharging circuit 201 for supplying a precharging signal having a predetermined voltage level to the plurality of data lines 35 before an image signal is supplied, a sampling circuit 301 for sampling the image signal and supplying the resultant signal to the plurality of data lines 35, a data line driving circuit 101, and a scanning line driving circuit 104.

The scanning line driving circuit 104 supplies a scanning signal in the form of a pulse in a line-sequential fashion to the scanning lines 31 in accordance with a clock signal CLY, an inverted clock signal $CLY_{INV}$, a start signal DY, and power supply voltages VDDY and VSSY, which are supplied from an external control circuit (not shown) via external terminals 102 shown in FIG. 2.

In synchronization with the scanning signal generated by the scanning line driving circuit 104, the data line driving circuit 101 generates a sampling circuit driving signal in accordance with a reference clock signal CLX, an inverted clock signal $CLX_{INV}$, a start signal DX, and power supply voltages VDDX and VSSX, which are supplied from the external control circuit (not shown) via external terminals 102 shown in FIG. 2. The sampling circuit driving signal is supplied to the sampling circuit 301 via the sampling circuit driving signal line 306. In response to the sampling circuit driving signal, the sampling circuit 301 samples any of image signals VID1–VID6 corresponding to the data lines 35 and writes the resultant signals on the corresponding data lines 35.

The precharging circuit 201 includes TFTs 202 for the respective data lines 35. The source electrode of each TFT 202 is connected to the precharging line 204. The gate electrode of each TFT 202 is connected to the precharging circuit driving signal line 206. In particular in the present embodiment, the precharging signal line 204 and the precharging circuit driving signal line 206 extend around the data line driving circuit 101 and the image displaying area and are connected to contacts 103*a* and 103*d* and contacts 103*b* and 103*c*, respectively, for connection to the external terminals 102. The same precharging signal NRS is supplied from the external control circuit to both contacts 103*a* and 103*d* via the external terminals 102, and the same precharging signal NRG is supplied to both contacts 103*b* and 103*c*. In this structure, the precharging signal and the precharging circuit driving signal are supplied from two sides of the image displaying area of FIG. 1 to the TFTs 202 in the precharging circuit 201. This allows all the TFTs 202 to turn on at the same time without any delay regardless of the location of the data lines even if a large interconnection capacitance associated with the data lines 35 is added to the precharging signal line 204 and the precharging circuit driving signal line 206. If the same signal is supplied from both the first and final stages of the precharging circuit 201 to at least either the precharging signal line 204 or the precharging circuit driving signal line 206, it is possible to reduce the difference in contrast between the left and right areas of the screen, as will be described in further detail later.

The sampling circuit 301 includes TFTs 302 for the respective data lines 35. The source electrode of each TFT 302 is connected to the corresponding image signal line 304. The gate electrode of each TFT 302 is connected to the corresponding sampling circuit driving signal line 306. When a sampling circuit driving signal is input to a TFT 302 from the data line driving circuit 101 via the sampling circuit driving signal line 306, that TFT 302 turns on. Thus the image signals VID1–VID6 supplied from the external control circuit via the image signal lines 304 are written on the corresponding data lines 35 via the TFTs 302 when the TFTs 302 are turned on.

In this embodiment, the image signal is supplied to the data lines line by line. However, in the present invention, the manner of supplying the image signal is not limited to that. For example, the sampling circuit driving signal may be supplied at the same time to the gate electrodes of six adjacent TFTs 302 so that a plurality of data lines 35 are successively selected from group to group. A similar operation may also be achieved by synchronizing the phases of six image signals VID1–VID6 using an external control circuit and supplying these image signals to the data lines via the TFTs 302. The number of serial-parallel conversion is not limited to six. For example, if the TFTs 302 of the sampling circuit 301 have a high ability in the sampling operation, the number of serial-parallel conversion may be smaller than six. On the other hand, the number of serial-paralle conversion may be greater than 6 if the ability of TFTs 302 is low. The cost of the external control circuit becomes lower with the decreasing number of serial-parallel conversion of the image signal. It is required to provide as many image input signal lines as the number of serial-parallel conversion of the image signal. If the number of serial-parallel conversion of the image signal is set to any of integral multiples of 3, that is, any of 3, 6, 12, 18, 24, . . . , then the number of image input signal lines becomes an integral multiple of 3. This is convenient when a video signal is displayed because a color image signal includes three color components (red, green, blue). That is, if the number of image input signal lines is an integral multiple of 3, simple control can be used to display an NTSC or PAL video signal and a simple circuit can be used.

The precharging circuit 201 and the sampling circuit 301 are disposed on the TFT array substrate 1, in the area denoted by diagonal shading in FIGS. 2 and 3, wherein the location of this area corresponds to the location of the light blocking frame 53 disposed on the opposite substrate 2. The data line driving circuit 101 and the scanning line driving circuit 104 are formed in a peripheral area of the TFT array substrate 1 wherein this area is not in contact with the liquid crystal layer 50.

The precharging circuit 201, the sampling circuit 301, the data line driving circuit 101, and the scanning line driving circuit 104 are mainly made up of TFTs. If the channel region made of an a-Si (amorphous silicon) film or a p-Si (polysilicon) film of the TFTs is exposed to light, a photocurrent is generated in the channel region by the photoelectric conversion effect and the transistor characteristic of the TFTs are degraded. In the present embodiment, to prevent the above problem, the peripheral area of the TFT array substrate 1 where the data line driving circuit 101 and the scanning line driving circuit 104 are formed is covered by a case made of an opaque material such as plastic. The precharging circuit 201 and the sampling circuit 301 are formed in the area of the TFT array substrate 1 under the light blocking frame 53. Furthermore, a testing circuit composed of TFTs for testing the quality or detecting defects of the liquid crystal device in the middle of production or before shipment may be formed in a remaining peripheral area of the TFT array substrate 1 or in a proper area under the light shielding film. Any other peripheral circuits composed of TFTs for improvement of the image quality, reduction in power consumption, or reduction in cost may also be formed in the peripheral area of the TFT array substrate 1 or in a proper area under the light blocking frame 53.

In FIGS. 2 and 3, a sealing material 52 such as a photo-setting resin serving as a sealing member is disposed on the TFT array substrate 1 and around the image displaying area (where an image is displayed by means of changing the orientation of the liquid crystal layer 50) in which a plurality of pixel electrodes 11 are disposed, in such a manner that the liquid crystal layer 50 is sealed within the space formed by bonding two substrates via the sealing material 52. The light blocking frame 53 is disposed on the opposite substrate 2, at a location between the sealing material 52 and the image displaying area.

The light blocking frame 53 is made of an opaque material into the form of a frame with a width of 500 $\mu$m or wider. The light blocking frame 53 is placed so that the image displaying area is surrounded by the light blocking frame 53 thereby creating a margin of a few hundred $\mu$m for dimensional or positioning errors which may occur when the TFT array substrate 1 is placed into an opaque case with an opening. This margin prevents the image displaying area from being partially hidden under the edge of the opening of the case when the TFT array substrate 1 is placed in the case. The light blocking frame 53 may be formed by depositing a metal material such as Cr (chromium) or Ni (nickel) on the opposite substrate 2 using sputtering, photolithography, and etching processes. Alternatively, the light blocking frame 53 may be made of for example a photoresist containing dispersed carbon or Ti (titanium), called a resin black.

Outside the sealing material 52 and along the lower side of the image displaying area, the data line driving circuit 101 and external terminals 102 are disposed. The scanning line driving circuits 104 are disposed outside the image displaying area and along the right and left sides of the image displaying area. In the case where a delay in the propagation of the scanning signal supplied to the scanning lines 31 is allowed, the scanning line driving circuit 104 may be disposed only on one side. The data line driving circuit 101 may be divided into two parts and they may be disposed at two sides of the image displaying area. For example, one data line driving circuit disposed along one side of the image display area may supply an image signal to odd-numbered data lines and another data line driving circuit disposed along the opposite side of the image displaying area may supply an image signal to even-numbered data lines. When the data lines 53 are driven in the comb fashion as described above, it is allowed to expand the area of the data line driving circuit is disposed and thus it becomes possible to employ a complicated circuit. The comb-type driving technique may also be applied to the scanning line driving circuit 104.

A plurality of interconnections 105 extend along the upper side of the image display area so that signals are transmitted via the interconnections 105 between two scanning line driving circuits disposed on right and left sides. A conductive material 106 is disposed on at least one corner of the opposite substrate 2 so that the TFT array substrate 1 and the opposite substrate 2 are electrically connected via the conductive material 106. The opposite substrate 2 having an outer shape and size similar to those of the sealing material 52 is bonded to the TFT array substrate 1 via the sealing material 52.

The precharging circuit 201 and the sampling circuit 301 both operate in an AC mode. Therefore, the liquid crystal layer 50 encounters no degradation due to application of a DC voltage even if the precharging circuit 201 and the sampling circuit 301 are formed on the TFT array substrate 1 in such an area which is in direct contact with the liquid crystal layer 50 disposed between the two substrates and surrounded by the sealing material 52. On the other hand, the data line driving circuit 101 and the scanning line driving circuit 104 are disposed in the peripheral area of the TFT array substrate 1 so that they are not in contact with the liquid crystal layer 50 thereby preventing the liquid crystal layer 50 from receiving leakage of a DC voltage component, especially from the data line driving circuit 101 and the scanning line driving circuit 104 which operate in a DC mode. If the data line driving circuit 101 or the scanning line driving circuit 104 are protected with a passivation film, they may be formed in contact with the liquid crystal layer 50.

By disposing the precharging circuit 201 and the sampling circuit 301 under the light blocking frame 53, it becomes possible to create enough space in the peripheral area of the TFT array substrate 1 so that the scanning line driving circuit 104 and the data line driving circuit 101 are disposed in this space. This allows a particular peripheral circuit to be easily designed as required. The area under the light blocking frame 53 was a dead space in the conventional electro-optical apparatus. In contrast, in the present invention, the precharging circuit 201 and the sampling circuit 301 are disposed in the area under the light blocking frame 53. This technique allows these circuits to be formed without causing a reduction in the effective displaying area of the liquid crystal device 200. Besides, because the light blocking frame 53 has a function of blocking light, it is not required to provide additional light blocking means on the TFTs 202 and 302 of the precharging circuit 201 and the sampling circuit 301 to protect these TFTs from light coming from the image display area. The precharging circuit 201 and the sampling circuit 301 are disposed on the TFT array substrate 1 so that they are not in contact with the sealing material 52 thereby ensuring that TFTs 202 and 302 of these circuits are not broken by a gap material contained in the sealing material 52. Furthermore, because it is not required to provide an additional light shielding film for protecting the TFTs 202 and 302 of these circuits, there is no possibility that the additional light shielding film prevents the sealing material 52 from being properly cured in a photo-curing process. That is, because no light shielding film is formed on both substrates at locations where the sealing material 52 is disposed, it is possible to illuminate the sealing material 52 with enough amount of light through both substrates in the photo-curing process. Therefore, it is not necessary to employ a thermoset resin, which would cause the substrate to be deformed, as the sealing material 52.

Figure 4A:
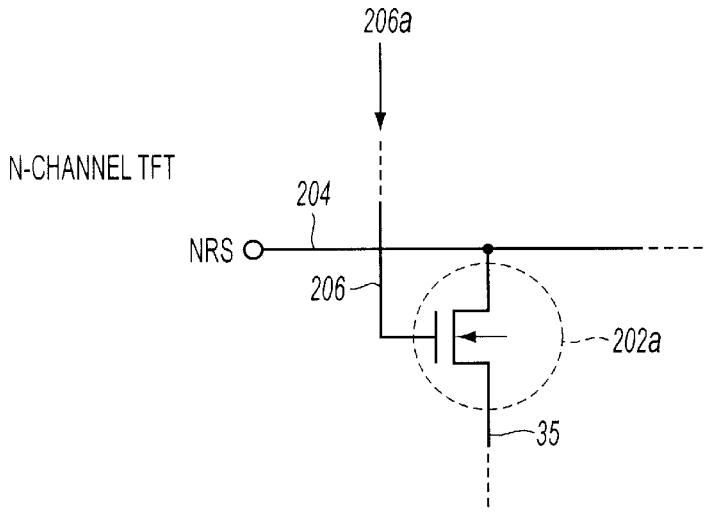
FIGS. 4(*a*)–(*c*) are circuit diagrams illustrating a TFT used in a precharging circuit of a liquid crystal device.
Figure 4B:
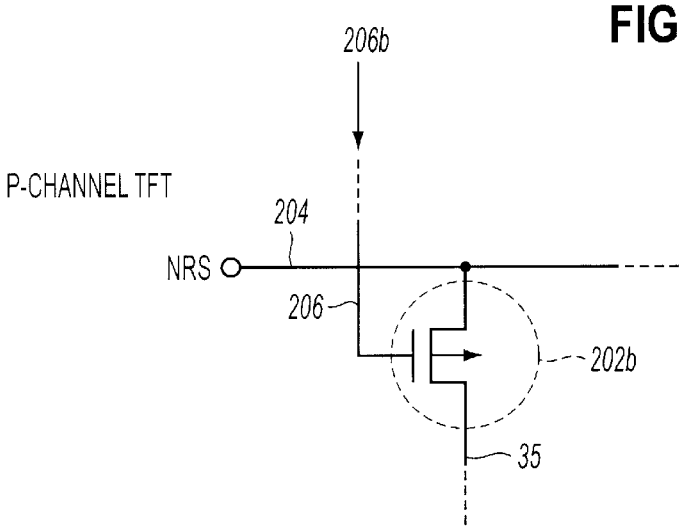
Figure 4C:
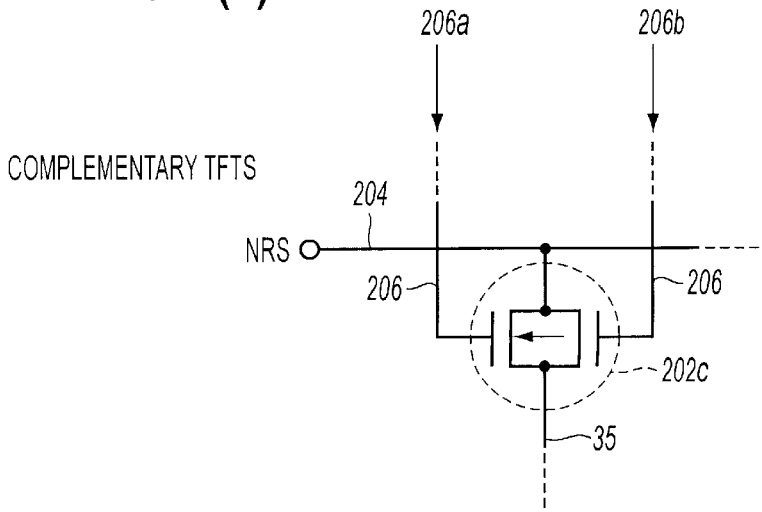
Figure 5A:
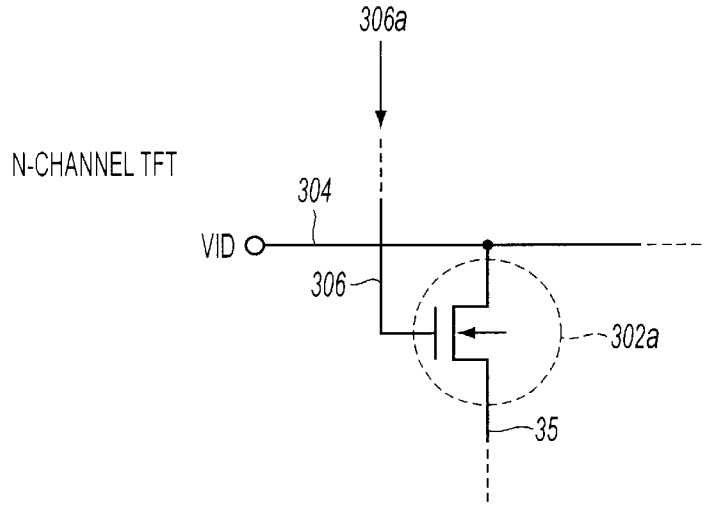
FIGS. 5(*a*)–(*c*) are circuit diagrams illustrating a TFT used in a precharging circuit of a liquid crystal device.
Figure 5B:
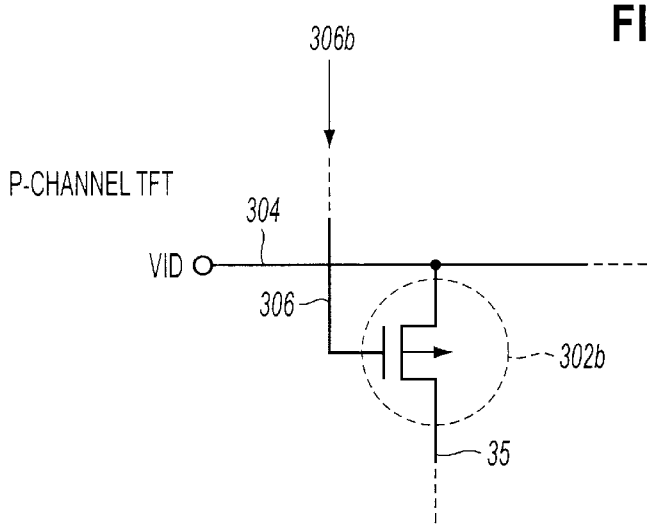
Figure 5C:
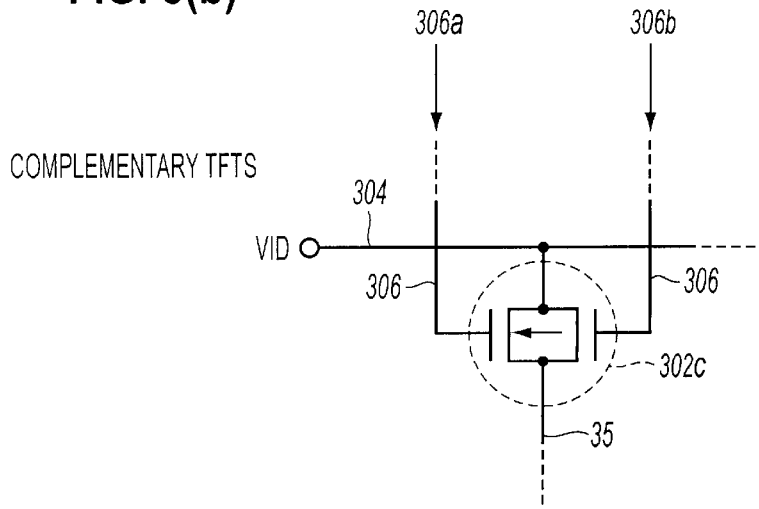

Referring now to FIGS. 4 and 5, a specific example of the circuit configurations of TFTs 202 and 302 for the precharging circuit 201 and the sampling circuit 301. FIGS. 4(*a*)–(*c*) are circuit diagrams illustrating various configurations which may be employed for TFTs 202 of the precharging circuit 201. FIGS. 5(*a*)–(*c*) are circuit diagrams illustrating various configurations which may be employed for TFTs 302 of the sampling circuit 301.

Each TFT 202 (FIG. 1) of the precharging circuit 201 may be constructed in the form of an N-channel TFT 202*a* as shown in FIG. 4(*a*) or into the form of a P-channel TFT 202*b* as shown in FIG. 4(*b*) or otherwise into the complementary fashion 202*c* consisting of an N-channel TFT and a P-channel TFT as shown in FIG. 4(*c*). In FIGS. 4(*a*)–4(*c*), the precharging circuit driving signals 206*a* and 206*b*, which are input via the precharging circuit driving signal line 206 shown in FIG. 1, are applied as the gate voltage to the respective TFTs 201*a* to 202*c*. Similarly, the precharging signal NRS, which is input via the precharging signal line 204 shown in FIG. 1, is applied as the source voltage to the respective TFTs 202*a* to 202*c*.

The precharging circuit driving signal 206*a* applied to the gate of the N-channel TFT 202*a* and the precharging circuit driving signal 206*b* applied to the gate of the P-channel TFT 202*b* are opposite in logical level to each other. This means that if the precharging circuit 201 is formed with complementary TFTs 202*c*, at least two lines are required for the precharging circuit driving signal lines 206. Alternatively, a signal 206*b* may be inverted and the waveform of the inverted signal 206 may be shaped using an inverter disposed just before the TFT 202*c*. In this case, only one line is required for the precharging circuit driving signal line 206. Therefore, no additional external terminals 102 or interconnections are required which would cause an increase in the pattern area.

Each TFT 302(FIG. 1) of the sampling circuit 301 may be constructed into the form of an N-channel TFT 302*a* as shown in FIG. 5(*a*) or into the form of a P-channel TFT 302*b* as shown in FIG. 5(*b*) or otherwise into the form of complementary TFTs 302*c* as shown in FIG. 5(*c*). In FIGS. 5(*a*)–5(*c*), image signals VID (for example VID1 to VID6), which are input via the image signal lines 304 shown in FIG. 1, are applied as source voltages to the respective TFTs 302*a* to 302*c*. On the other hand, sampling circuit driving signals 306 and 306*b*, which are input from the data line driving circuit 101 via the sampling circuit driving lines 306 shown in FIG. 1, are applied as gate voltages to the respective TFTs 302*a* to 302*c*.

In the sampling circuit 301, as in the precharging circuit 201 described above, the sampling circuit driving signal 306*a* applied to the gate of the N-channel TFT 302*a* and the sampling circuit driving signal 306*b* applied to the gate of the P-channel TFT 302*b* are opposite in logical level to each other. Therefore, in the case where the sampling circuit 301 is formed with complementary TFTs 302*c*, at least two sampling circuit driving signal lines 306*a* and 306*b* are required for the sampling circuit driving signal lines 306.

Figure 6:
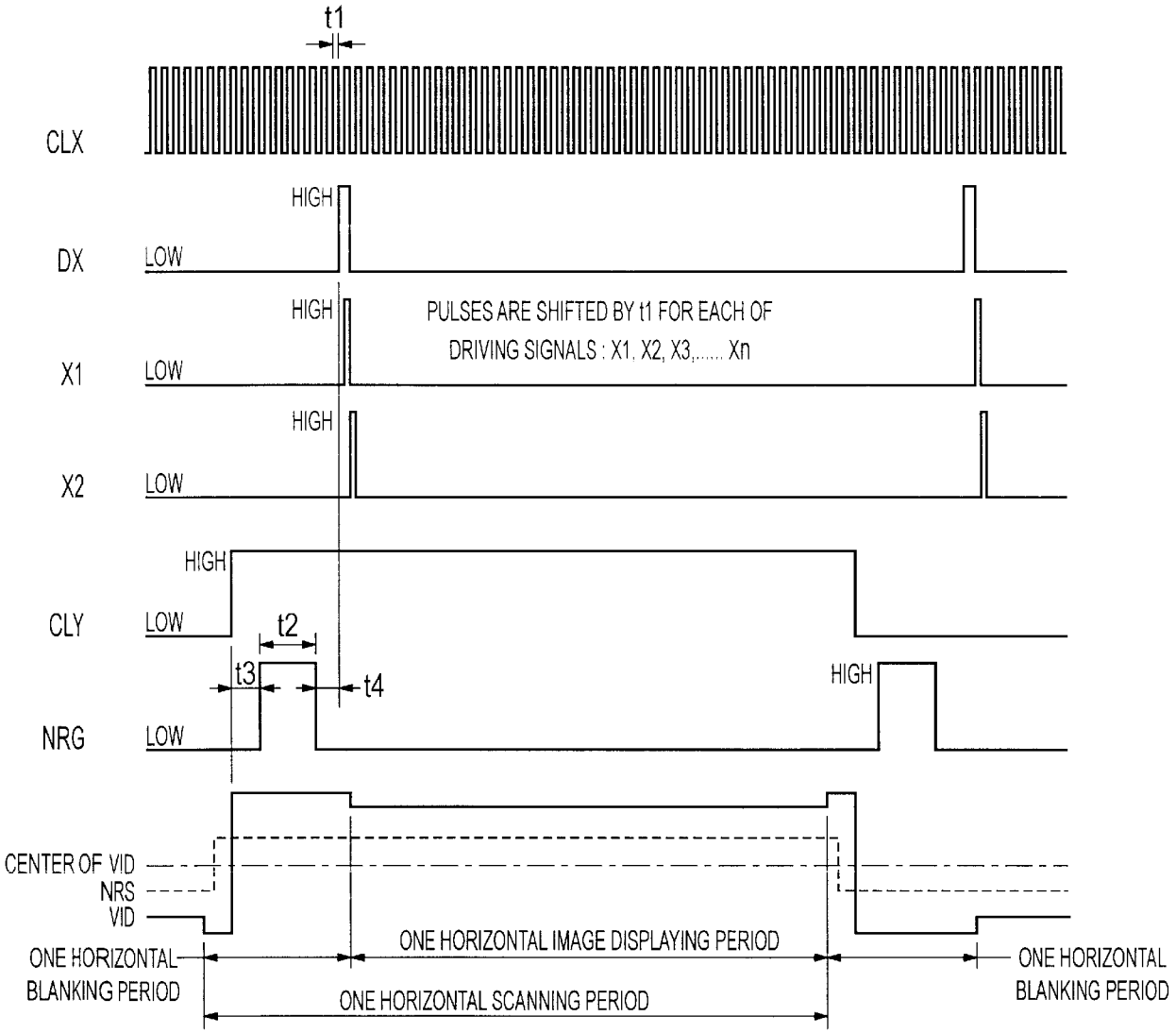
FIG. 6 is a timing chart associated with a precharging circuit driving signal and a sampling circuit driving signal used in the liquid crystal device.

The precharging operation performed by the precharging circuit 201 composed of TFTs is described in detail below with reference to the timing chart shown in FIG. 6. In FIG. 6, X1, X2, . . . and so on denote sampling circuit driving signals which are generated by the data line driving circuit 101 and supplied to the TFTs 302 in the sampling circuit 301 via the sampling circuit driving signal lines 306.

Figure 7:
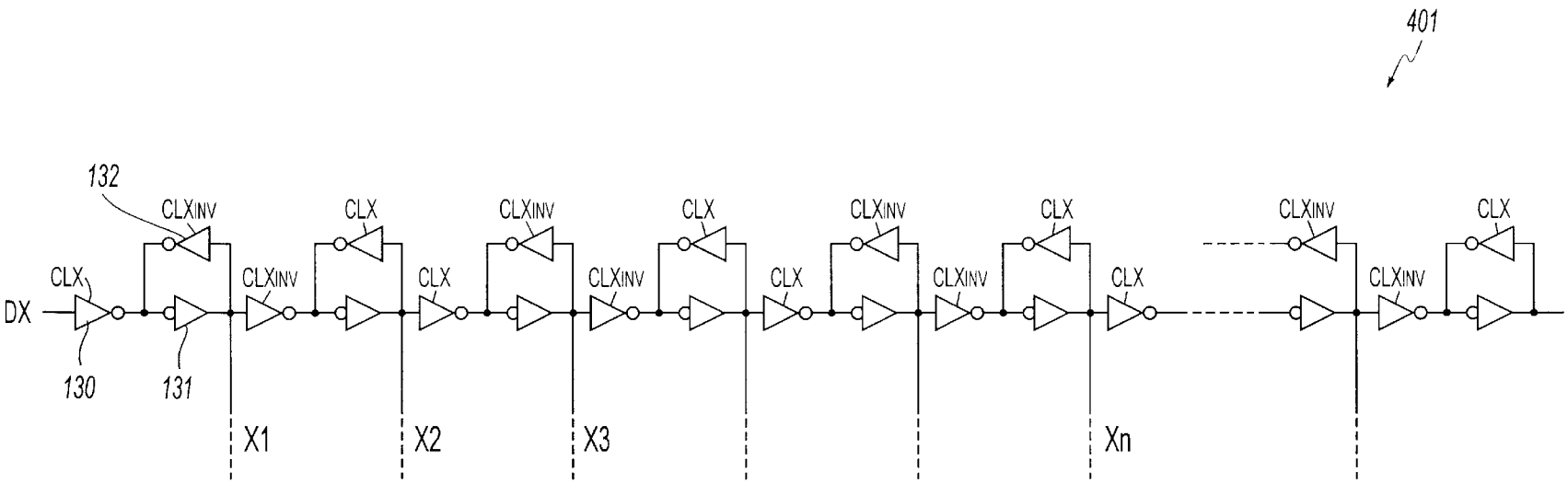
FIG. 7 is a circuit diagram illustrating a shift register used in the liquid crystal device.

The data line driving circuit 101 includes a shift register 401 such as that shown in FIG. 7. The shift register 401 includes a plurality of stages each consisting of an inverter 131 and clocked inverters 130 and 132. As shown in FIG. 6, when a reference clock signal CLX and an inverted clock signal $CLX_{INV}$, which determine the selection time t1 per pixel, are applied to the shift register 401 via the external terminal 102, the reference clock signal CLX and the inverted clock signal $CLX_{INV}$ are applied as reference horizontal scanning signals to the clocked inverters 130 and 132, respectively. Similarly, a start signal DX is applied via an external terminal 102 to the clocked inverter 130 at the first stage of the shift register 401. After the shift register 401 starts to operate in response to the above-described signals, sampling circuit driving signals X1, X2, . . . and so on are successively output from the respective stages of the shift register 401 for one horizontal image displaying time. In the circuit configuration according to the present embodiment shown in FIG. 1, the sampling circuits corresponding to the respective data lines 35 are successively driven one by one. Therefore, one half of the repetition period of the reference clock signal CLX corresponds to the selection time t1. On the other hand, if the sampling circuit 301 connected to six adjacent data lines is driven at the same time, then one half of the repetition period of the reference clock signal CLX corresponds to ⅙ of the selection time t1. As described above, the technique according to the present embodiment allows a reduction in the driving frequency of the shift register 401. The reduction in the driving frequency results in not only a reduction in the power consumption but also an increase in the life time of TFTs of the shift register. At a proper time in each horizontal blanking time before the start signal DX is input, a precharging circuit driving signal NRG is supplied. In the present embodiment, the precharging circuit driving signal NRG is supplied via external terminals 102 and via both contacts 103*b* and 103*c* to the precharging circuit driving signal line 206 from two sides of the precharging circuit 201. More specifically, when the clock signal CLY serving as a vertical scanning reference signal changes to a high level, the image signal VID is inverted in polarity with reference to the central value of the signal voltage (VID center voltage). The precharging circuit driving signal NRG is raised to a high level when the time period t3 has elapsed since the polarity inversion of the image signal VID wherein the time period t3 is a margin from the polarity inversion to the starting time of the precharging. On the other hand, in response to the inversion of the image signal VID, the precharging signal NRS is set to a proper level with the same polarity as the polarity of the image signal VID during the horizontal blanking time. That is, precharging is performed for a period of time t2 during which the precharging circuit driving signal NRG is at the high level. The precharging circuit driving signal NRG is then lowered to a low level, t4 before the start of the image displaying time so that there is a margin of t4 in time between the end of the precharging and the start of writing the image signal VID. In each horizontal blanking time, as described above, the precharging circuit 201 supplies the precharging signal NRS to the data lines 35 before the image signals (for example VID1–VID6) are supplied to the data lines 35. In the present embodiment, the precharging signal NRS is supplied to the precharging signal line 204 via external terminals 102 and two contacts 103*a* and 103*d* so that the precharging signal NRS is supplied from two sides of the precharging circuit 201.

Furthermore, when all TFTs 202 of the precharging circuit 201 are turned on at the same time for the period t2 shown in FIG. 6 and thus the interconnection capacitance of a large number of data lines 35 is added to the precharging signal line 204, no signal delay occurs because the signal is also supplied from the side where a signal delay would occur in the conventional structure. Thus the precharging signal NRS is written on all the data lines 35 so that all the data lines have the same voltage. This makes it possible to greatly reduce the charges needed to write the image signals on the data lines 35. Furthermore, it is possible to eliminate the non-uniformity in contrast between the data lines 35 on the left side and those on the right side.

The above-described feature of the liquid crystal device 200 according to the present invention is the greatest difference from that of the conventional liquid crystal device. For the purpose of comparison, the typical structure of the conventional liquid crystal device 200' is shown in FIG. 20.

Figure 20:
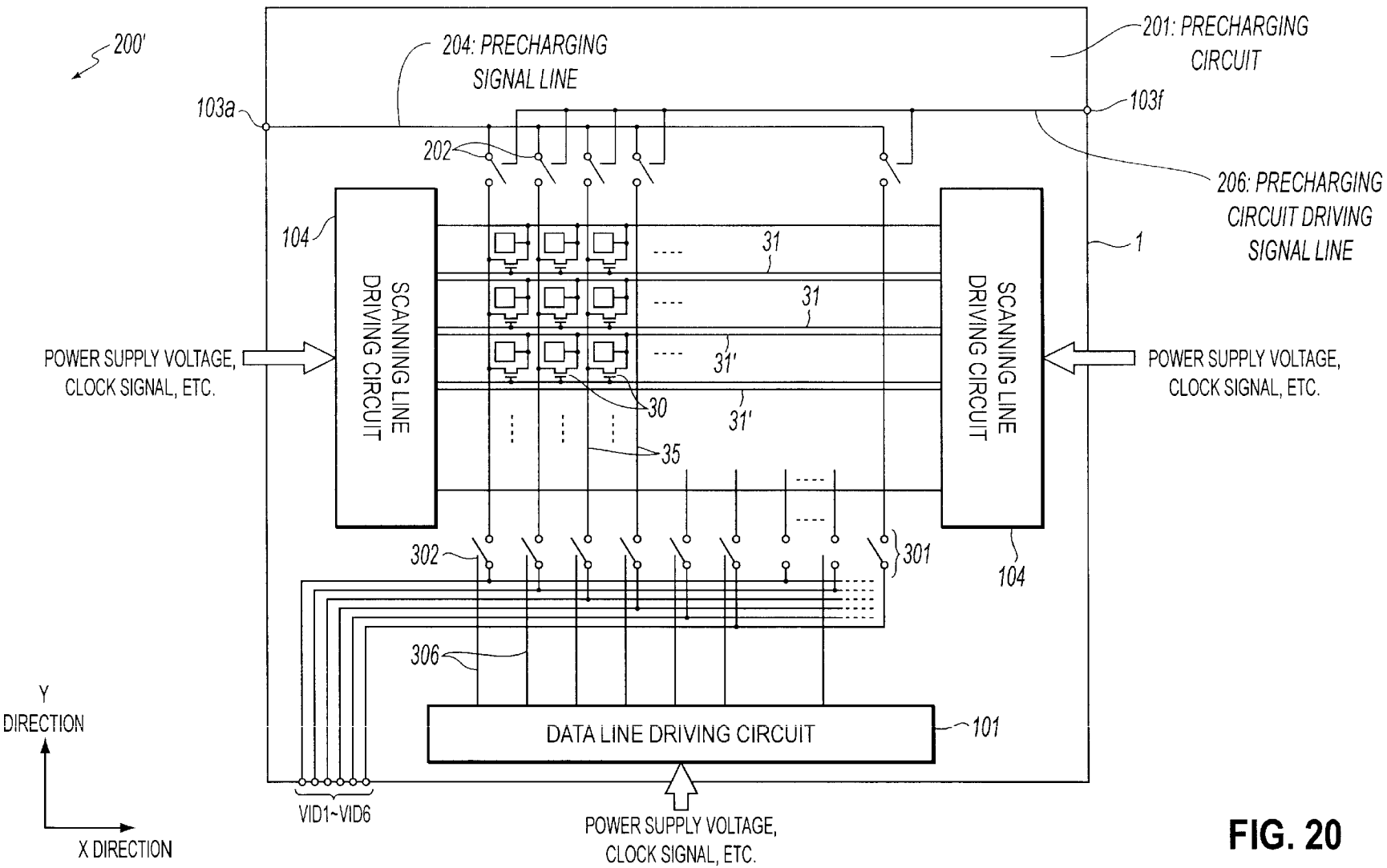
FIG. 20 is a block diagram illustrating a liquid crystal device including various interconnections and peripheral circuits formed on a TFT array substrate, according to a conventional technique.

In the conventional liquid crystal device, as shown in FIG. 20, a precharging signal line 204' is connected to only one contact 103*e* and the end of the precharging line 204' is connected to a TFT 202 located on the extreme right side of the precharging circuit 201. Similarly, a precharging circuit driving signal line 206' is also connected to only one contact 103*f* and its end is connected to a TFT 202 located on the extreme left side of the precharging circuit 201. In this structure, the interconnection capacitance of the precharging circuit driving signal line 206' itself causes a delay in the precharging circuit driving signal which increases with the location along the precharging circuit driving signal line 206' toward the left. That is, the delay in the turning-on timing of the TFTs 202 increases with the location toward the left. This also results in a difference in the on-period for each TFT 202 and thus a difference in the time of wiring the precharging signal on each data line 35. As a result, a difference is produced in the precharged voltage on the data lines 35.

Also in the conventional liquid crystal device, all the TFTs 202 of the precharging circuit 201 are turned on in the horizontal blanking period, and thus the interconnection capacitance of all the data lines 35 is added to the precharging signal line 204'. As a result, the delay in supplying the precharging signal to the data lines 35 increases with the location toward the right in FIG. 20. Thus, in the structure shown in FIG. 20, the amount of charge written on the data lines 35 in the precharging process decreases with the location toward the right. As a result, visible non-uniformity in the contrast occurs when the image signal is written. The non-uniformity in the contrast is rather small and allowable in practical applications in which one liquid crystal device is used, However, for example, if three liquid crystal devices are combined to produce a liquid crystal projector, a great non-uniformity in color occurs which cannot be neglected in practical use.

Figure 8:
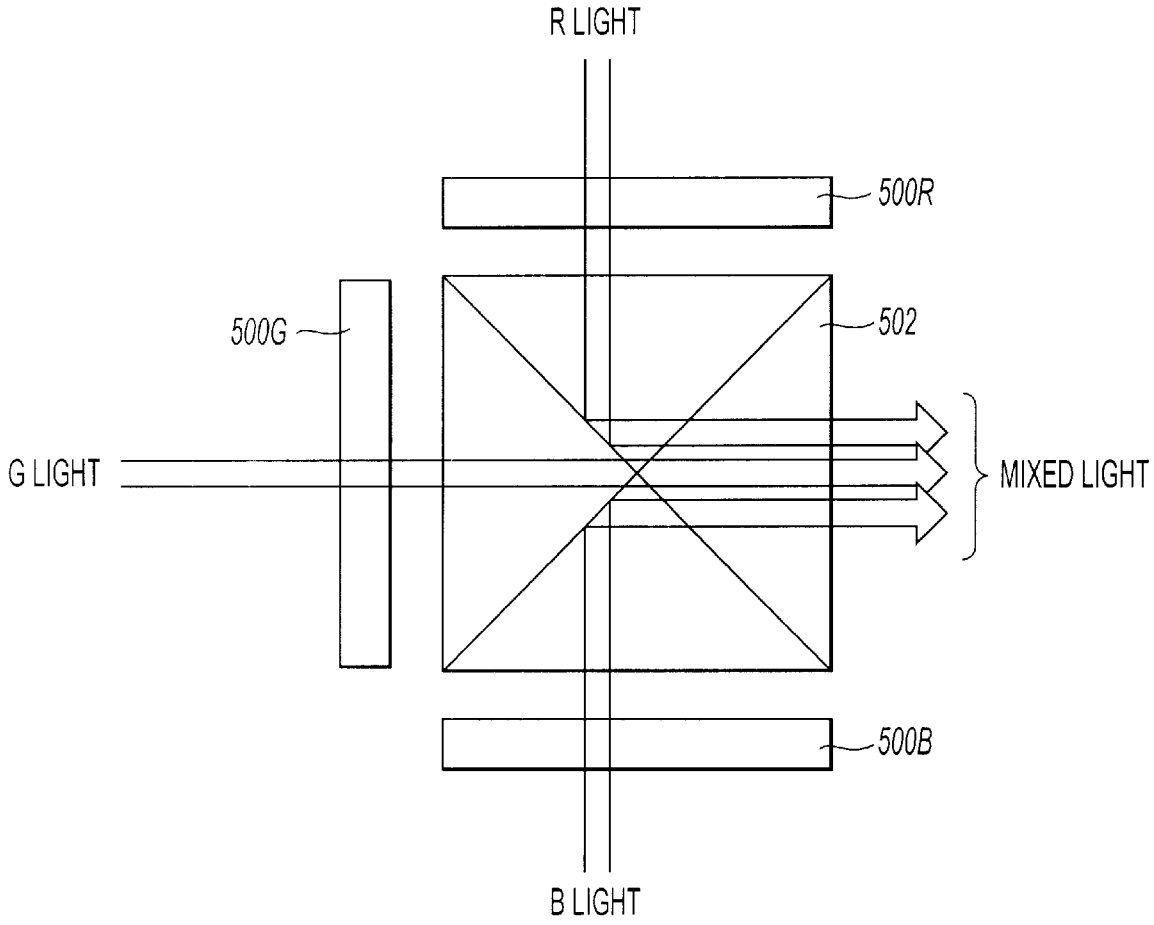
FIG. 8 is a block diagram schematically illustrating the structure of a three-panel liquid crystal projector using liquid crystal devices.
Figure 9A:
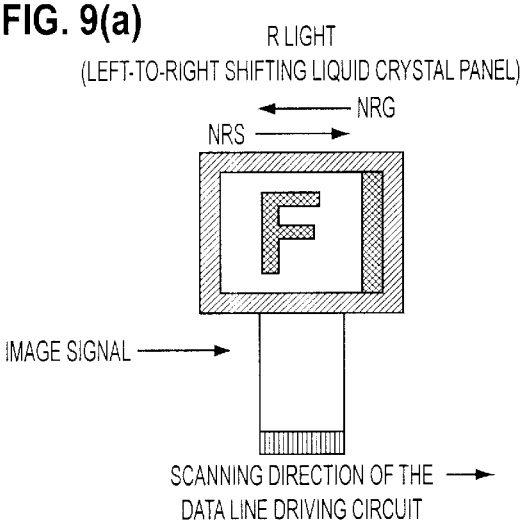
FIGS. 9(*a*)–(*f*) illustrate the manner in which images are formed on light valves for various colors in the three-panel liquid crystal projector, wherein FIGS. 9(*a*)–(*c*) illustrate an example in which the transfer direction of shift register of the data line driving circuit is inverted only for the green light liquid crystal device and FIG. 9(*d*)–(*f*) illustrate an example in which the image signal supplied to the green light liquid crystal device is inverted on a memory.
Figure 9B:
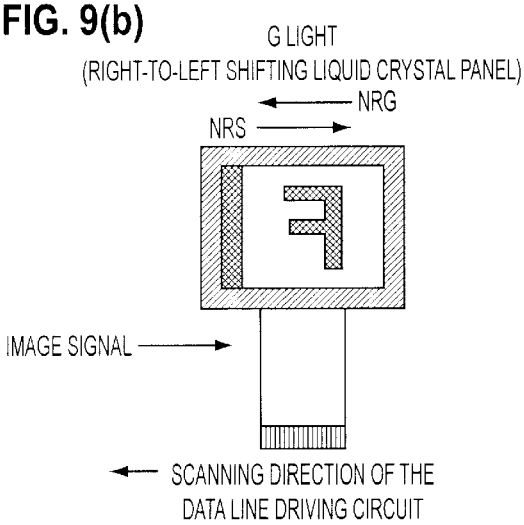
Figure 9C:
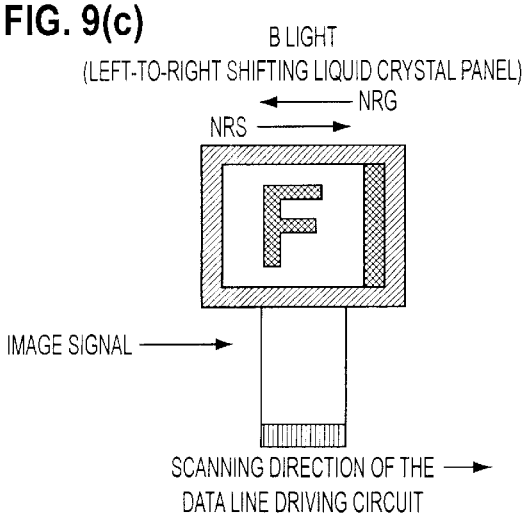
Figure 9D:
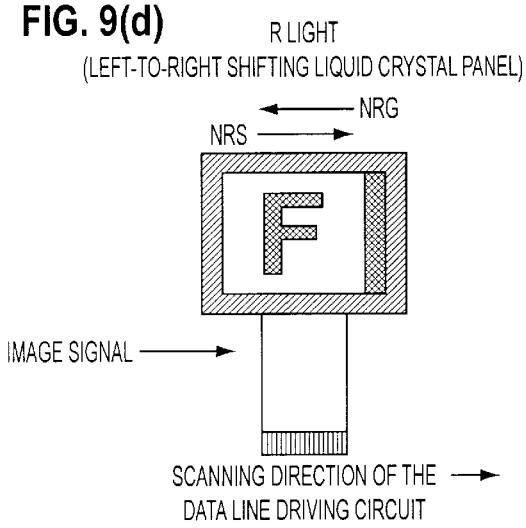
Figure 9E:
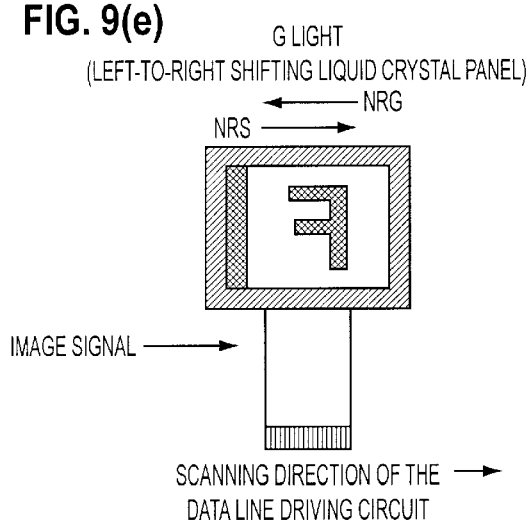
Figure 9F:
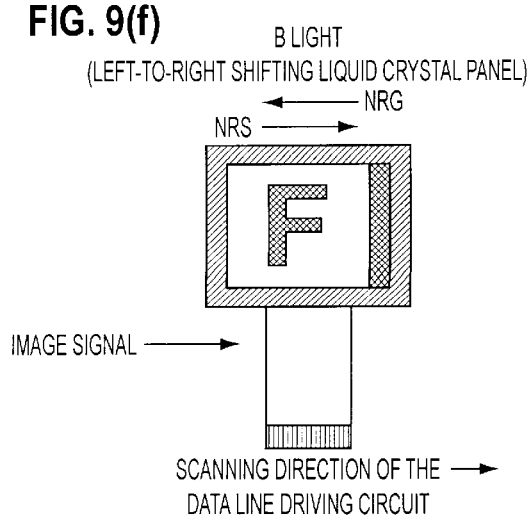

FIG. 8 schematically illustrates the structure of a liquid crystal projector including three liquid crystal devices. This liquid crystal projector employs three liquid crystal devices, having no color filters and thus having no colors, as light valves 500R, 500G, and 500B for RGB. The respective light valves are illuminated with light with three colors R, G, and B, respectively, as shown in FIG. 8. The light beams with three colors are separately light-modulated by the three light valves 500R, 500G, and 500B, respectively, and mixed into a single projection light beam through a dichroic mirror or prism 502. The resultant light beam is projected onto a screen.

In this technique in which light beams are mixed with the prism 502 or the like, the G light beam is not reflected by the prism 502 and thus it encounters inversion one less number of times after being light-modulated than the R and B light beams. If the optical system is constructed in such a manner that the R or B light beam, instead of the G light beam, are not reflected by the prism 502, the situation will be similar to the above. This is also the case when three colors are mixed using a dichroic mirror or the like. In this technique, therefore, it is required to make lateral inversion on the image signal of the G light beam passing through the light valve 500G before writing it on the data lines.

FIG. 9 illustrates techniques of making lateral inversion on the image signal of the G light beam. In FIG. 9, all liquid crystal devices are assumed to be seen from the side of the TFT array substrate 1. The precharging circuit driving signal NRG, the precharging signal NRS, and the image signal are transmitted in directions denoted by arrows. That is, the image signal is written in the same direction as the scanning direction of the data line driving circuit. In the case of FIGS. 9(*a*)–(*c*), the scanning direction of the data line driving circuit 101 is set to a right-to-left direction (in a direction from right to left in FIG. 9) only for the liquid crystal device used as the light valve 500G illuminated with the G light beam, and the scanning direction of the data line driving circuit 101 is set to a left-to-right direction (in a direction from left to right in FIG. 9) for the other light valves 500R and 500B. In the case of FIGS. 9(*d*)–(*f*), the scanning direction of the data line driving circuit 101 is set to the same direction for all liquid crystal devices used as light valves 500R, 500G, and 500B, but the contents of the image memory from which the image signal is generated are inverted only for the light valve 500G illuminated with the G light beam. In any case, three colors can be mixed using the technique shown in FIG. 8.

If the liquid crystal projector of the type described above is constructed using liquid crystal devices according to the conventional technique shown in FIG. 20, although the reduction in contrast occurs on the same side for the R and B light beams, the contrast becomes low on the opposite side for the G light beam. This causes the mixed light beam to have a non-uniformity in color. More specifically, in FIGS. 9(*a*)–(*c*) and 9(*d*)–(*f*), the images formed by the light valves 500R and 500B have a lower intensity on the right side than the left side of the image displaying area. That is, the color of the band-shaped portion becomes lower in intensity than that of the character "F". However, since the non-uniformity in color occurs in the same direction for both light valves, the non-uniformity in color is not perceptible for the projection light beam generated by mixing only these two light valves. In contrast, the image signal is inverted for the light valve 500G illuminated with the G light beams, and thus the color of the band-shaped portion has a higher intensity than that of the character "F". This means that the non-uniformity in contrast occurs in an opposite direction to that of the light beams projected through the former two light valves. As a result, perceptible color non-uniformity occurs and thus a desired color balance cannot be obtained in the resultant light beam which is a mixture of three light beams passing through the three light valves.

The above problem with the color non-uniformity can be avoided and a good color image can be obtained if the liquid crystal projector shown in FIG. 8 is constructed using liquid crystal devices 200 according to the present embodiment of the invention.

That is, in the liquid crystal device 200 according to the present embodiment, as described above, the precharging circuit driving signal line 206 and the precharging signal line 204 are formed in such a manner that both ends of the respective lines are connected to two different contacts 103*b* and 103*c* or 103*a* and 103*d* wherein one contact for the respective lines is disposed at one side of the precharging circuit 201 and the other contact is disposed at the other side so that the precharging circuit driving signal NRG and the precharging signal NRS are each supplied from two sides of the precharging circuit 201. The propagation delay, due to the interconnection capacitance of the precharging circuit driving signal line 206 itself, associated with the precharging driving signal NRS supplied from the right side of the precharging circuit 201 increases with the location along the line 206 toward the left. However, in the liquid crystal device 200 according to the present embodiment, the same precharging circuit driving signal NRG is also supplied from the left side of the precharging circuit 201, and thus no delay associated with the precharging circuit driving signal NRG occurs in the precharging circuit 201. As a result, all TFTs 202 in the precharging circuit 201 have the same on-period and thus the period of writing the precharging signal NRS becomes the same for all data lines 35.

Similarly, the propagation delay, due to the interconnection capacitance of the data lines 35 and the on-resistance of TFTs 202, associated with the precharging signal NRS supplied from the right side of the precharging circuit 201 increases with the location toward the left. However, in the present embodiment, the precharging signal NRS is also supplied from the left side of the precharging circuit 201 and thus no delay associated with the precharging signal NRS occurs in the precharging circuit 201.

Thus, the precharged voltage becomes the same for all data lines 35 and no difference occurs in the contrast when the image signal with the same voltage is written via the sampling circuit 301. When liquid crystal devices 200 according to the present embodiment are used as the light valves in the three-panel liquid crystal projection shown in FIG. 8, non-uniformity in contrast does not occur in any of the light valves 500R, 500G, and 500B and thus an extremely good image having no non-uniformity in color can be displayed even if three colors are mixed in such a manner that the image is inverted only for the light valve 500G.

As described above, the liquid crystal device is useful in particular when it is used in the liquid crystal projector, such as that shown in FIG. 8, including a plurality of liquid crystal devices.

When a high-speed display mode such as an XGA or SXGA mode is employed, the number of data lines 35 becomes about twice that required in the conventional display mode and thus the interconnection capacitance associated with the data lines 35 added to the precharging signal line 204 increases by a factor of about two. However, in the present embodiment, because the precharging circuit driving signal NRG and the precharging signal NRS are supplied from two sides of the precharging circuit 201, a high-precision image can be displayed without having a delay in propagation of the precharging signal NRS even in the case where all TFTs in the precharging circuit are turned on at the same time.

Figure 10A:
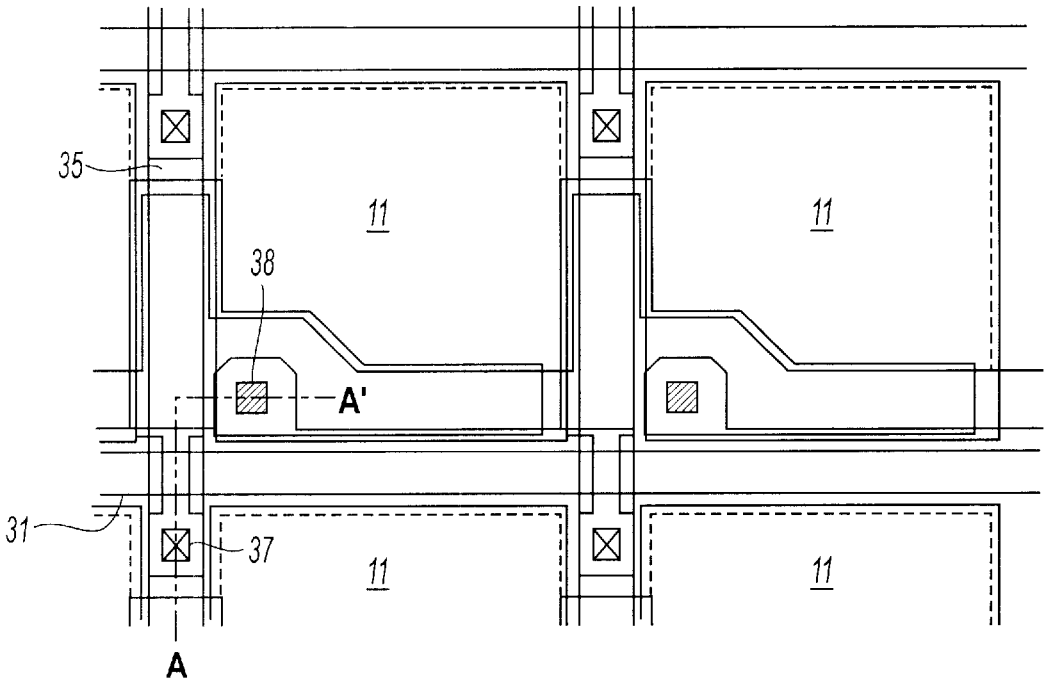
FIGS. 10(*a*)–(*b*) are schematic diagrams illustrating some adjacent pixels included in an image display area of a TFT array substrate wherein FIG. 10(*a*) is a plan view and FIG. 10(*b*) is a cross-sectional view taken along line A–A' of FIG. 10(*a*).
Figure 10B:
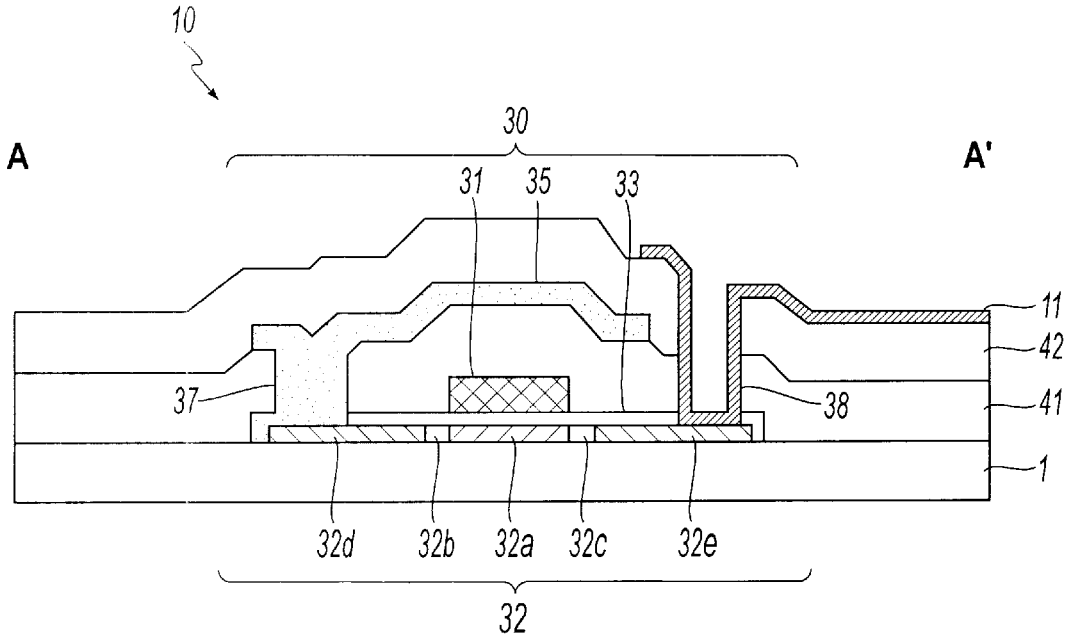
Figure 21A:
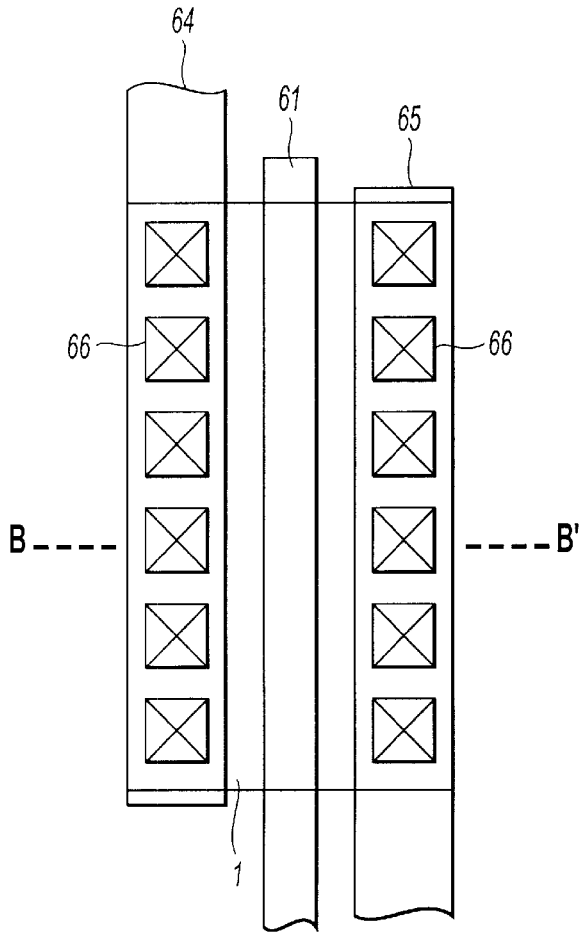
FIGS. 21(*a*)–(*b*) are schematic diagrams illustrating a TFT used in a peripheral circuit formed on a TFT array substrate wherein FIG. 21(*a*) is a plan view illustrating the pattern of the TFT and FIG. 21(*b*) is a cross-sectional view taken along line B–B' of FIG. 21(*a*).
Figure 21B:
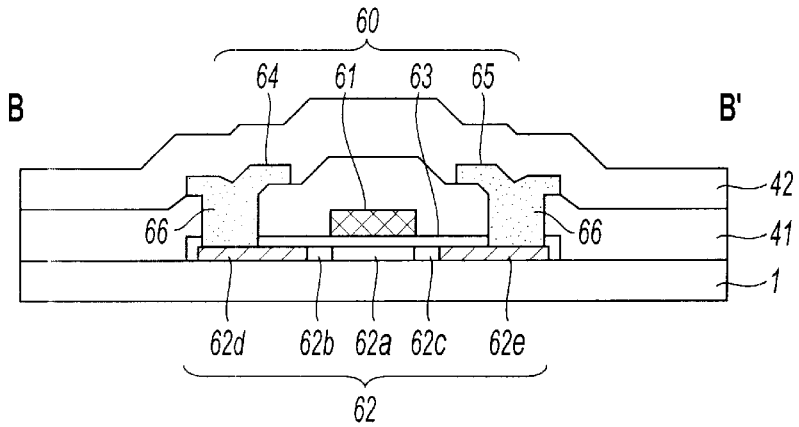

Referring now to FIGS. 10(*a*)–(*b*) and 21(*a*)–(*b*), specific examples are described below in terms of the construction of a pixel part in the image display area on the TFT array substrate 1 of the liquid crystal display device 200 and also the construction of peripheral circuits. FIG. 10(*a*) is a plan view illustrating various electrodes and other elements formed on the TFT array substrate. FIG. 10(*b*) is a cross-sectional view taken along line A–A' of FIG. 10(*a*) wherein the structure of a pixel switching TFT is shown in FIG. 10(*b*). FIG. 21(*a*) is a plan view of a single conduction type TFT, that is, either a P-channel TFT or an N-channel TFT. FIG. 21(*b*) is a cross-sectional view taken along line B–B' of FIG. 21(*a*). In FIGS. 10(*a*) and 21(*a*), the layers and other elements are not drawn to scale in order to provide an easier understanding.

As shown in the plan view of FIG. 10(*a*), pixel electrodes 11 are disposed in a matrix fashion on the TFT array substrate 1. A TFT 30 is disposed at a location adjacent to each pixel electrode 11. Data lines 35 and scanning lines 31 are formed in such a manner that they extend along the vertical and horizontal boundaries, respectively, of the pixel electrodes 11. Although in the present embodiment, only one pixel switching TFT 30 for controlling the pixel electrode 11 is disposed for each pixel electrode 11, a dual gate TFT may also be employed in which two gate electrodes formed by a part of scanning lines 31 are disposed between the source and drain of the TFT 30 and connected to each other via contact holes 37 and 37. Three or more gates may be disposed in a similar manner. When a plurality of gates are disposed in the TFT 30, the TFT 30 has a larger off-resistance which results in a reduction in leakage current in the off-state. In FIG. 10(*b*), the structure of a pixel part of the pixel electrode array is shown in a simplified fashion. The practical pixels have a more complicated three-dimensional structure in which various electrodes extend on an insulating layer or between two interlayer insulating films and they are electrically connected via contact holes.

As shown in FIG. 10(*b*), a TFT 30 of each pixel of the liquid crystal device includes a TFT array substrate 1, a first interlayer insulating film 41, a semiconductor layer 32, a gate insulating film 33, a scanning line 31, a second interlayer insulating film 42, a data line 35, and a pixel electrode 11 on the TFT array substrate 1.

The TFT array substrate 1 serving as an underlying material of the TFT 30 is an insulating substrate made of, for example, glass or quartz. The semiconductor layer 32 is formed on the TFT array substrate 1 so that a channel is formed in the semiconductor layer 32 in response to an electric field applied by the scanning line 31.

The semiconductor layer 32 may be formed, for example, by depositing an a-Si (amorphous silicon) film on the TFT array substrate 1 serving as the underlying material and then performing an annealing process thereby forming a solid phase grown semiconductor layer with a thickness of about 50 to 200 nm. After that, the gate insulating film 33 is formed by means of thermal oxidation or a similar technique. The gate electrode formed by a part of the scanning line 31 is then formed on the gate insulating film 33. In the case where the TFT is produced into the form of an N-channel TFT, a V-group element such as Sb (antimony), As (arsenic), or P (phosphorus) serving as a dopant is selectively doped by means of, for example, ion implantation into particular regions of the semiconductor layer 32 thereby forming source and drain regions. On the other hand, in the case where the TFT is produced into the form of a P-channel TFT, a III-group element such as Al (aluminum), B (boron), Ga (gallium), or In (indium) serving as a dopant is selectively doped by means of, for example, ion implantation into particular regions of the semiconductor layer 32 thereby forming source and drain regions. The doping is performed using the gate electrode formed by a part of the scanning line 31 as a mask so that the region where nothing is doped becomes a channel region 32*a*. In particular when the TFT 30 is produced into the form of an N-channel TFT with an LDD (lightly doped drain) structure, the source and drain regions are partially doped with a V-group element such as P serving as a dopant so that a lightly doped source region 32*b* and a lightly doped drain region 32*c* are formed at locations adjacent to the channel region 32*a* and the remaining parts of the source and drain regions are heavily doped with a V-group element such as P serving as a dopant so that a heavily doped source region 32*d* and a heavily doped drain region 32*e* are formed. When the TFT 30 is produced into the form of a P-channel TFT with an LDD structure, the source and drain regions are partially doped with a III-group element such as B serving as a dopant so that a lightly doped source region 32*b* and a light doped drain region 32*c* are formed at locations adjacent to the channel region 32*a* and the remaining parts of the source and drain regions are heavily doped so that a heavily doped source region 32*d* and a heavily doped drain region 32*e* are formed. The N-channel TFT has the advantage that it can operate at a high speed and thus N-channel TFTs are usually employed as the pixel switching TFTs 30.

When the TFTs are formed into the LDD structure, it is possible to suppress the short channel effects. Alternatively, nothing may be doped into the lightly doped source 32*b* and the lightly doped drain region 32*c* so as to form the TFT 30 into an offset structure. Still alternatively, high-concentration impurity ions may be implanted using the gate electrode as a mask so as to form self-aligned heavily doped source region 32*d* and heavily doped drain region 32*e* thereby producing the TFT in a self-aligned type TFT.

The gate insulating film 33 may be obtained by thermally oxidizing the semiconductor layer 32 at a temperature of 900 to 1300° C. thereby forming a thermal oxide film with a rather thin thickness of 30 to 150 nm.

The first interlayer insulating film 41 and the second interlayer insulating film 42 may be made up of a silicate glass film such as NSG, PSG, BSG, BPSG, silicon nitride film, or a silicon oxide film with a thickness of 500 to 1500 nm. Furthermore, a planarizing film may be formed by means of a spin coating technique or the like on the second interlayer insulating film 42 or a CMP process may be performed on the second interlayer insulating film 42. Alternatively, the surface of the second interlayer insulating film 42 itself may be planarized. By planarizing the surface on which the pixel electrode 11 is to be formed, it becomes possible to minimize the region where the liquid crystal has desclination due to a failure in the rubbing process.

A contact hole 37 is formed in the first interlayer insulating film 41 in such a manner that the contact hole 37 reaches the heavily doped source region 32*d*. Furthermore, a contact hole 38 is formed in the first interlayer insulating film 41 and the second interlayer insulating film 42 in such a manner that the contact hole 38 reaches the heavily doped drain region 32*e*. The data line 35 is electrically connected to the heavily doped source region 32*d* via the contact hole 37. The pixel-electrode 11 is electrically connected to the heavily doped drain region 32*e* via the contact hole 38. High-precision contact holes can be formed using a dry etching process such as reactive ion etching, reactive ion beam etching, etc. A combination of a wet etching process and a dry etching process may also be employed so as to form contact holes having a tapered side wall which can prevent the interconnection from being disconnected at a step of the contact holes. The tapered contact holes may also be obtained by performing a dry etching process in such a manner that a resist is laterally etched during the etching process.

In general, when the polysilicon film of the semiconductor layer 32 forming the channel is illuminated with light, a photocurrent is generated in the polysilicon film due to the photoelectric conversion effect of the polysilicon film. Such a photocurrent results in degradation in the transistor characteristics of the TFT 30. In the present embodiment, the above problem is prevented by forming a light shielding film 23 made of Cr or the like on the opposite substrate 2, at locations corresponding to the respective TFTs 30 as shown in FIG. 6 so that the semiconductor layer 32 is prevented from being directly exposed to the incoming light. Furthermore, or instead, the data line 35 may be formed of a thin film of opaque metal such as Al in such a manner that the gate electrode is covered with the data line 35 thereby ensuring that the semiconductor layer 32 is effectively shielded, in conjunction with the light shielding film 23 and/or by the data line itself, against the light traveling toward the semiconductor layer 32. Although an additional process step is required, a light shielding film may also be formed of refractory metal such as W (tungsten) or Mo (molybdenum) or an alloy such as metal silicide under the semiconductor layer 32 via an insulating film such as a silicon oxide film or a silicon nitride film in such a manner that the light shielding film is present at least under the channel region including the boundaries with the source and the drain regions thereby blocking the light reflected from the back surface of the TFT array substrate. The shielding film ensures that the TFT 30 has no degradation in terms of the transistor characteristics even when the liquid crystal device is exposed to high-intensity light. This means that an illumination light source emitting light with higher intensity may be employed. That is, no further means such as a microlens for improving the efficiency of light is required and thus it is possible to produce a high-brightness liquid crystal device at low cost. The above-described light shielding film may be connected to the power supply or the like so that the light shielding film is maintained at a constant voltage thereby preventing the pixel switching TFT from having degradation in the transistor characteristics.

The scanning lines 31 may be formed by depositing a polysilicon film by means of a low-pressure CVD process or the like and then performing a photolithography process and an etching process on the deposited film. Alternatively, the scanning lines may also be formed of a metal film such as W (tungsten) or Mo (molybdenum) or an alloy film such as metal silicide. This technique makes it possible to realize scanning lines 31 with a low resistance and thus it is possible to prevent degradation in the image quality due to the delay in propagation of the scanning signal. Furthermore, it is possible to reduce the width of the scanning lines 31 themselves so as to realize a liquid crystal device with a reduced size without causing a significant influence on the pixel opening (light transmission portion). Furthermore, the scanning lines 31 may also be used as the light shielding film. In this case, the light shielding film 23 on the opposite substrate 2 may be removed. In the case where there is no light shielding film 23, high positioning accuracy is not required in the process of bonding the TFT array substrate 1 to the opposite substrate 2, and thus it is possible to realize a liquid crystal device with no variation in the transmittance.

The data lines 35 may be formed by depositing a film of a low-resistivity metal such as Al or an alloy such as a metal silicide with a thickness of about 100 to 500 nm by means of sputtering or the like and then performing a photolithography process and an etching process on the resultant film. The above-described precharging signal line 204, the precharging circuit driving signal line 206, and other signal lines may be formed of the same film as that used to form the data lines 35. In this case, it is possible to achieve low-resistance signal lines which results in a small propagation signal delay.

The pixel electrodes 11 are formed of a transparent and conductive thin film such as an ITO (indium tin oxide) film on the upper surface of the second interlayer insulating film 42. The pixel electrodes 11 may be formed by depositing an ITO film or the like with a thickness of about 50 to 200 nm by means of, for example, sputtering and then performing a photolithography process and an etching process on the deposited film. When the liquid crystal device 200 is used in the reflection type liquid crystal device, the pixel electrodes 11 may be formed of an opaque material having a high reflectivity such as Al.

FIG. 21(*a*) illustrates the basic structure, in plan view, of the P-channel TFT or the N-channel TFT used to control the peripheral circuits such as the data line driving circuit 101, the scanning line driving circuit 104, the precharging circuit 201, and the sampling circuit 301. FIG. 21(*b*) illustrates a cross section of the TFT, taken along line B–B' of FIG. 21(*a*). The TFT 60 is similar to the pixel switching TFT 30 shown in FIG. 10(*a*) except for only one difference in that although the pixel electrode 11 serving as the drain electrode of the TFT 30 is made of ITO, the drain electrode of the TFT 60 is made of aluminum. Thus, it is possible to form the TFT 60 using almost the same thin-film forming process as that for forming the TFT 30 in the pixel region.

More specifically, a semiconductor layer 62 is formed on the TFT array substrate 1, and a channel region 62*a*, a lightly doped source region 62*b*, a heavily doped source region 62*d*, a lightly doped drain region 62*c*, and a heavily doped drain region 62*e* are formed in the semiconductor layer 62. A gate insulating film 63 is then formed on the semiconductor layer 62 and a gate electrode 61 is formed on the gate insulating film 63. Furthermore, a source electrode 64 and a drain electrode 65 are electrically connected to the heavily doped source region 62*d* and the heavily doped drain region 62*e*, respectively, via contact holes 66 formed in the first interlayer insulating film 41. Furthermore, a second interlayer insulating film 42 is formed in such a manner that the source electrode 64 and the drain electrode 65 are covered with the second interlayer insulating film 42.

The semiconductor layer 62 corresponds to the semiconductor layer 32 of the TFT 30 in the pixel region, the channel region 62*a* to the channel region 32*a* of the TFT 30, the lightly doped source region 62*b* to the lightly doped source region 32*b* of the TFT 30, the heavily doped source region 62*d* to the heavily doped source region 32*d* of the TFT 30, the lightly doped drain region 62*c* to the lightly doped drain region 32*c* of the TFT 30, and the heavily doped drain region 62*e* to the heavily doped drain region 32*e* of the TFT 30. These corresponding portions may be formed in the same process. In the case where the pixel switching TFT 30 is produced into the form of an N-channel TFT, if an additional process such as ion implantation is performed to dope a III-group element thereby forming a P-channel TFT 60, it is possible to form the peripheral circuits with complementary TFTs.

Although in the present embodiment the TFTs 60 in the peripheral circuits are also formed into the LDD structure, the TFTs 60 may be formed into an offset structure or a self-aligned structure. In the case where the self-aligned structure is employed, the resultant TFTs 60 have a high mobility and thus the circuits with these TFTs 60 can operate at a high speed.

Furthermore, the gate insulating film 63 corresponds to the gate insulating film 33 and the gate electrode 61 corresponds to the gate electrode 31 of the TFT 30, and thus they can be produced in the same process. The source electrode 64 and the drain electrode 65 correspond to the source electrode 35 of the TFT 30, and thus they can be produced in the same process.

Another advantage of the present embodiment is that because the TFT 30 is of the p-Si (polysilicon) type, it is possible to form the peripheral circuits such as the sampling circuit 201, the precharging circuit 301, the data line driving circuit 101, and the scanning line driving circuit 104 composed of polysilicon type TFTs 202, 302, etc., using the same thin-film forming process as that used to form the TFT 30. More specifically, as in the case of the precharging circuit 201 and the sampling circuit 301, the data line driving circuit 101 and the scanning line driving circuit 104 may be formed in a peripheral area of the TFT array substrate 1 using a plurality of complementary TFTs each including an N-channel TFT and a P-channel TFT such as those shown in FIGS. 4(*c*) and 5(*c*), respectively.

As described above, the image signal lines 304, the precharging signal line 204, and the precharging circuit driving signal line 206 may be formed of a metal film such as aluminum or a metal alloy film having a low resistance in the same process as that used for the formation of the TFT 30 at the same time, which is advangateous in manufacturing.

Although not shown in FIG. 10, a polarizing film, a phase difference film, and/or a polarizing plate are properly disposed on the side of the opposite substrate 2 which is exposed to the projection light beam and also on the side of the TFT array substrate 1 from which the projection light beam emerges, depending on the operation mode such as an TN (twisted nematic) mode, an STN (super TN) mode, a D-STN (double STN) mode, or normally white mode/normally black mode.

When the above-described liquid crystal device is used in the color liquid crystal projector, three similar liquid crystal devices 10 are used as RGB light valves, respectively, wherein light beams with different colors created by passing a light beam through RGB color separation dichroic mirrors are passed through the respective liquid crystal devices 10. Therefore, in the embodiments of the invention, no color filter is disposed on the opposite substrate 2. However, in the liquid crystal device according to the present embodiment, an RGB color filter with a protective film may also be formed on the opposite substrate 2, in proper areas corresponding to the pixel electrodes 11 where no black matrix 23 is formed. This allows the liquid crystal device according to the present embodiment to be employed in a color liquid crystal apparatus of a type other than the liquid crystal projector, such as a direct-view-type or reflection-type color liquid crystal television set.

In the present embodiment, the switching devices of the liquid crystal device are each formed into the structure of a normal stagger type or coplanar type polysilicon TFT. Alternatively, an inverted stagger type TFT, an amorphous silicon TFT, or other types of TFTs may also be employed in the present embodiment.

Furthermore, although in the liquid crystal device described above, a nematic liquid crystal is employed by example as the liquid crystal layer 50, a macromolecular dispersion type liquid crystal consisting of a macromolecular material containing dispersed liquid crystal particles may also be employed. In this case, the orientation films 12 and 22, the polarizing film, and the polarizing plate become unnecessary. This allows an improvement in the efficiency of using light. As a result, it is possible to realize a high-brightness and low-power liquid crystal device. In the case where the pixel electrodes 11 are made of a metal film having a high reflectivity, such as Al, and the resultant liquid crystal device is used in a reflection type liquid crystal apparatus, it is possible to employ an SH (super homeotropic) type liquid crystal in which liquid crystal moleculars are substantially vertically oriented when no voltage is applied. Although in the liquid crystal device according to the present embodiment, a common electrode 21 is formed on the opposite substrate 2 so that a vertical electric field is applied to the liquid crystal layer 50, a pair of electrodes of the common electrode 21 and pixel electrode 11 may be constructed for generating a transverse electric field applied to the liquid crystal layer 50 (in this case, each pair of electrodes for generating a transverse electric field is formed on the TFT array substrate 1 and no electrode for generating a vertical electric field is formed on the opposite substrate 2). When the transverse electric field is employed, it is possible to achieve a wider viewing angle than can be achieved with the vertical electric field. Other various types of liquid crystal materials, operating modes, liquid crystal arrangements, and driving techniques may also be employed in the present embodiment.

Figure 11:
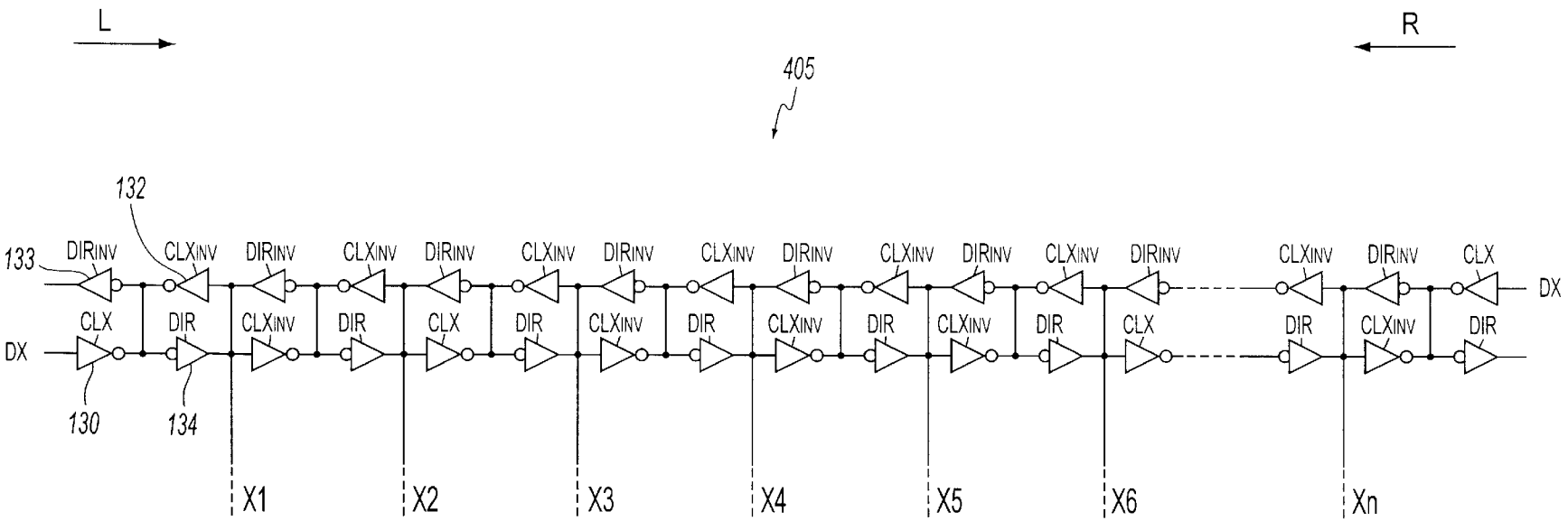
FIG. 11 is a circuit diagram illustrating the structure of a shift register used in a liquid crystal device according to a second embodiment of the invention.

Referring to FIG. 11, a second embodiment of the invention is described below. Similar parts to those in the first embodiment are denoted by similar reference numerals and they are not described in further detail here.

The present embodiment is different from the first embodiment in that the shift register of the data line driving circuit 101 is constructed into the form of a bidirectional shift register 405 as shown in FIG. 11.

In this bidirectional shift register 405, as shown in FIG. 11, each stage consists of four clocked inverters 130, 132, 133, and 134. Transfer direction control signals DIR and $DIR_{INV}$ are supplied to the clocked inverters 134 and 133, respectively. When the transfer direction control signal DIR is at a high level, the start signal DX is successively transferred in a direction from left to right. On the other hand, when the transfer direction control signal $DIR_{INV}$ is at a high level, the start signal DX is successively transferred in a direction from right to left.

If the data line driving circuit 101 is constructed using the bidirectional shift register 405, it becomes possible to invert the image to be displayed not only in a lateral direction but also in a vertical direction.

By employing the above-described circuit configuration, it becomes possible to realize a the multipanel liquid crystal projector capable of being placed on a desk or hung from a ceiling. Furthermore, it becomes possible to realize a single-panel liquid crystal apparatus which can be used as a liquid crystal monitor capable of being turned around the fulcrum of a flexible joint depending on the position of a user. This type of liquid crystal apparatus may be advantageously used, for example, in a portable video camera.

In the present embodiment, because the bidirectional shift register 405 is used and the precharging circuit driving signal NRG and the precharging signal NRS are supplied, as in the first embodiment, from two sides of the precharging circuit 201, non-uniformity in contrast does not occur even when the image is inverted vertically or laterally. Therefore, if the liquid crystal device according to the present embodiment is employed as the light valves, it is possible to realize a three-panel liquid crystal projector capable of displaying a high-quality color image having no non-uniformity in color regardless of whether it is placed on a desk or hung from a ceiling.

Figure 12:
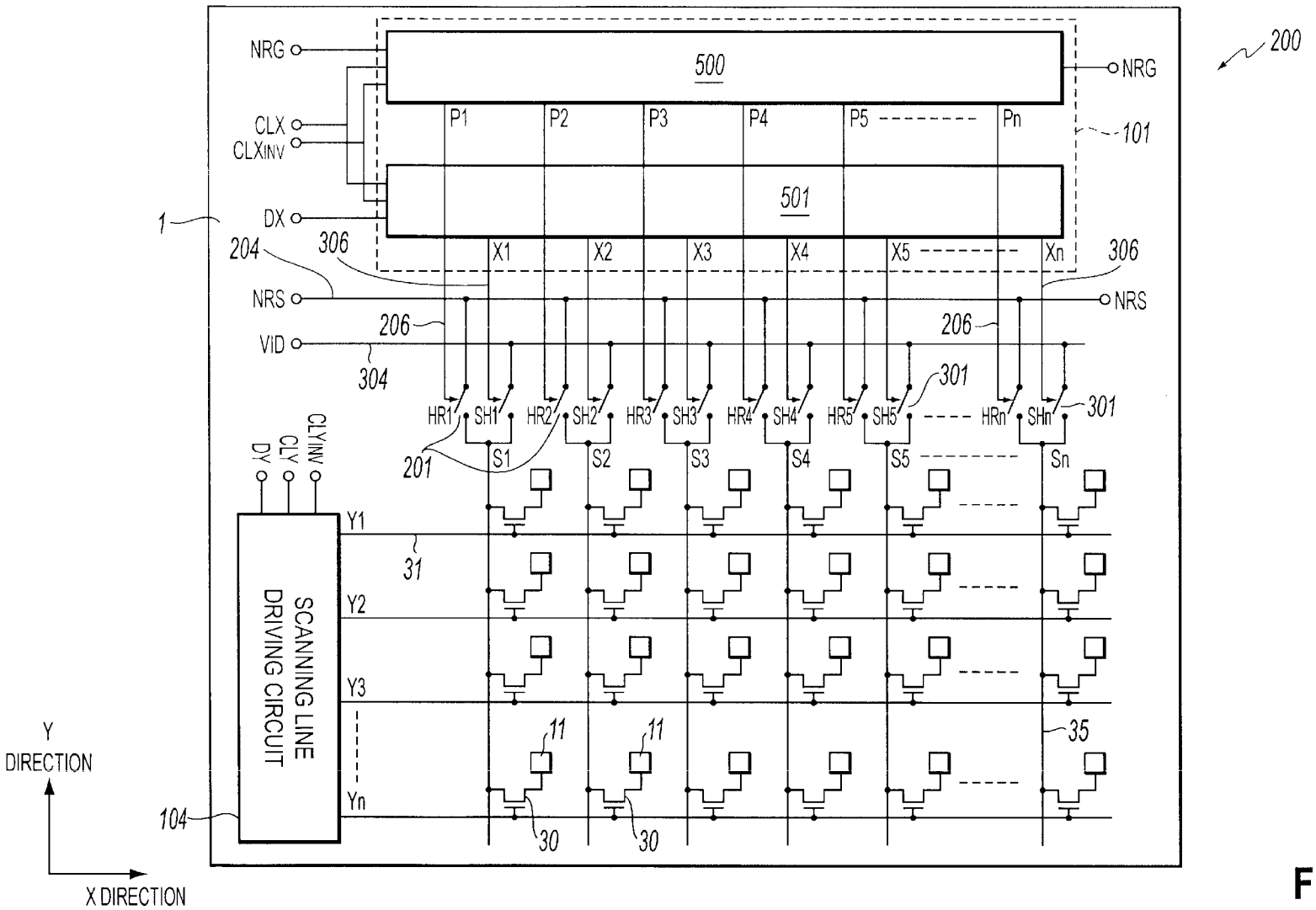
FIG. 12 is a block diagram illustrating a liquid crystal device including various interconnections and peripheral circuits formed on a TFT array substrate, according to a third embodiment of the invention.
Figure 13:
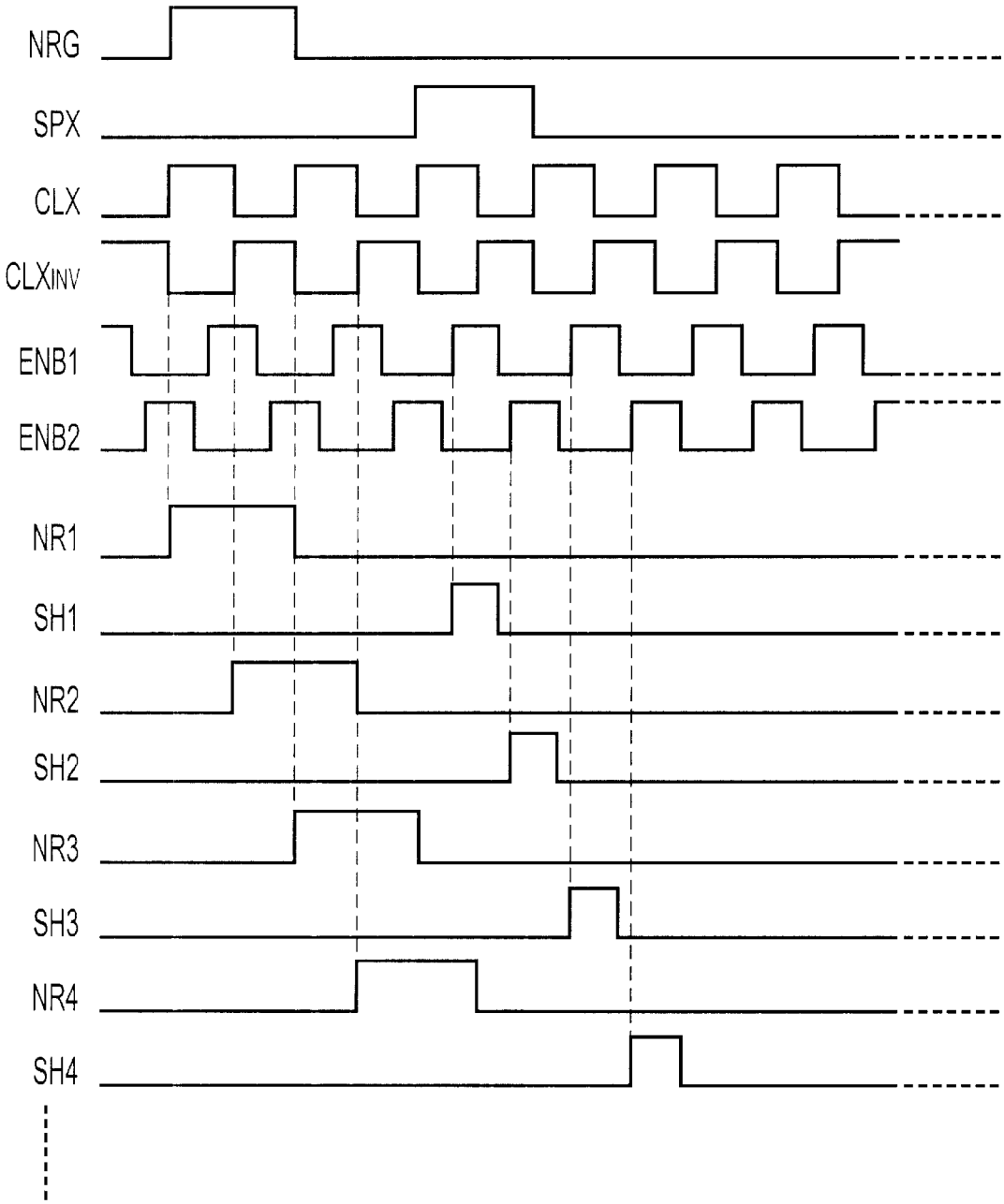
FIG. 13 is a timing chart associated with a precharging circuit driving signal and a sampling circuit driving signal used in the liquid crystal device according to the third embodiment of the invention.

Referring now to FIGS. 12 and 13, a third embodiment of the invention is described below. Similar parts to those in the first embodiment are denoted by similar reference numerals and they are not described in further detail here.

The present embodiment is different from the first embodiment in that the data line driving circuit 101, the sampling circuit 301, and the precharging circuit 201 are all formed on the same side with respect to the data lines 35.

In the present embodiment, the data line driving circuit 101 includes a precharging signal driving circuit 500 and an image signal driving circuit 501 each including a shift register. As shown in FIG. 13, sampling circuit driving signals (SH1, SH2, . . . ) are output in a line-sequential fashion from the image signal driving circuit 501 to the sampling circuit 301 and precharging circuit driving signals (NR1, NR2, . . . ) are output in a line-sequential fashion from the precharging signal driving circuit 500 to the precharging circuit 201.

If there is a delay in the propagation of the precharging circuit driving signal and the precharging signal, the pulse width of the precharging circuit driving signal varies from one data line 35 to another and thus the precharged voltage on the data lines 35 varies from one data line 35 to another.

However, in the present embodiment, because the precharging circuit driving signal NRG is supplied from two sides of the precharging signal driving circuit 500 and the precharging signal NRS is supplied from two sides of the precharging circuit 201 as shown in FIG. 12, the precharging circuit driving signal and the precharging signal have no propagation delay and thus a high-quality image can be displayed.

In this third embodiment, there is provided a NAND circuit between the output signal of the shift register of the image signal driving circuit 501 and the waveform control signals ENB1 and ENB2 supplied from the outside whereby the waveform of the sampling circuit driving signals (SH1, SH2, . . . ) output from the image signal driving circuit 501 are controlled so that there are no overlaps among them as shown in FIG. 13 thereby preventing the image signal from having degradation such as ghosts. The precharging signal driving circuit 500 may have a similar structure to that of the image signal driving circuit 501 or may be adapted to output precharging circuit driving signals (NR1, NR2, . . . ) with a longer pulse width thereby providing a long enough precharging period.

Furthermore, because the precharging circuit 201 is disposed together with the data line driving circuit 101 and the sampling circuit 301 at the same side of the data lines 35 and the sampling circuit 301 and the precharging circuit 201 are connected in parallel, the non-image area can be used in a highly efficient manner and thus it is possible to reduce the size of the liquid crystal device.

In the case where the shift register is of the bidirectional type, the order in which the precharging signal is written on the data lines 35 changes depending on the transfer direction of the data line driving signal 101. However, as described above, the precharging signal is written on the data lines 35 in a similar manner regardless of the transfer direction, because the precharging signal is supplied from two sides of the precharging circuit 201. Therefore, a high-quality image including no non-uniformity in contrast can be displayed even when the image is displayed in an inverted fashion.

Figure 14:
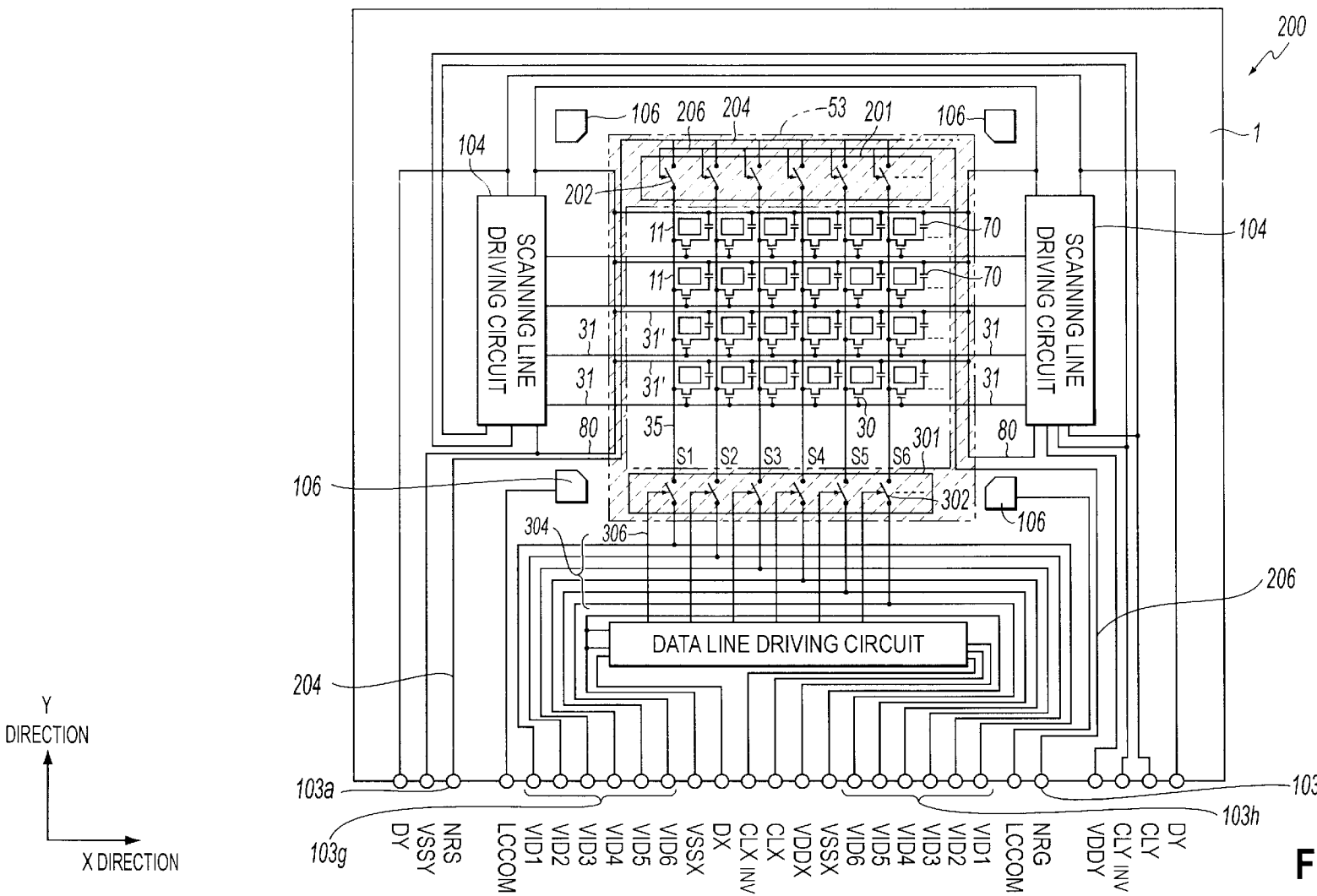
FIG. 14 is a block diagram illustrating a liquid crystal device including various interconnections and peripheral circuits formed on a TFT array substrate, according to a fourth embodiment of the invention.

Referring now to FIG. 14, a fourth embodiment of the invention is described below. Similar parts to those in the first embodiment are denoted by similar reference numerals and they are not described in further detail here.

This fourth embodiment is different from the first embodiment in that the precharging circuit driving signal line 206 and the precharging signal line 204 extend from either one side of the image displaying area, that is, the precharging circuit driving signal line 206 from left and the precharging signal line 204 from left, while image signal lines 304 extend from two sides of the data line driving circuit 101 and image signals VID1–VID6 are supplied from two sides of the data line driving circuit 101. Furthermore, there are provided separate signal supplying contacts 103*g* and 103*h* so that the same image signals VID1–VID6 are supplied through both right and left image signal lines 304. As in the case of the precharging signal, the image signals may also have a problem due to the signal propagation delay. In the present embodiment, to avoid such a problem, the image signals are supplied from two sides of the sampling circuit 301 thereby ensuring that the image signals have no propagation delay and thus there is no non-uniformity in contrast and color.

Figure 15:
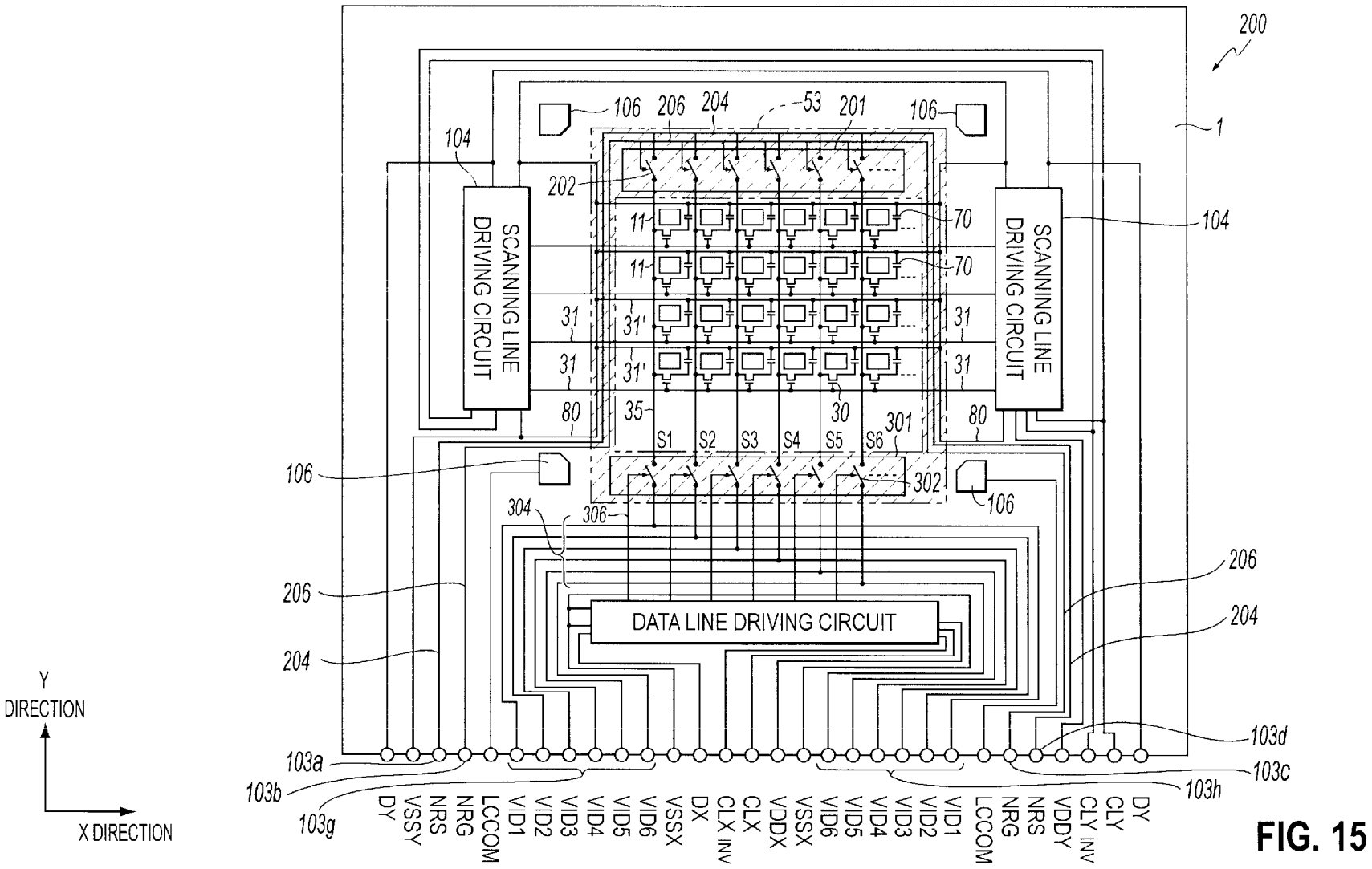
FIG. 15 is a block diagram illustrating a liquid crystal device including various interconnections and peripheral circuits formed on a TFT array substrate, according to a fifth embodiment of the invention.

A fifth embodiment of the invention is described below with reference to FIG. 15. Similar parts to those in the first embodiment are denoted by similar reference numerals and they are not described in further detail here.

This fifth embodiment is different from the first embodiment in that the precharging circuit driving signal line 206 and the precharging signal line 204 extend at both right and left sides of the image displaying area and the image signal lines 304 extend to the data line driving circuit 101 from two sides.

In the present embodiment, the precharging circuit driving signal NRG, the precharging signal NRS, and the image signals VID1–VID6 are supplied to the precharging circuit 201 or the sampling circuit 301 from their two sides thereby ensuring that no signal propagation delay occurs and thus there is no non-uniformity in contrast and color.

Examples of electronic apparatus including the liquid crystal device 200 are described below with reference to FIGS. 16–19.

Figure 16:
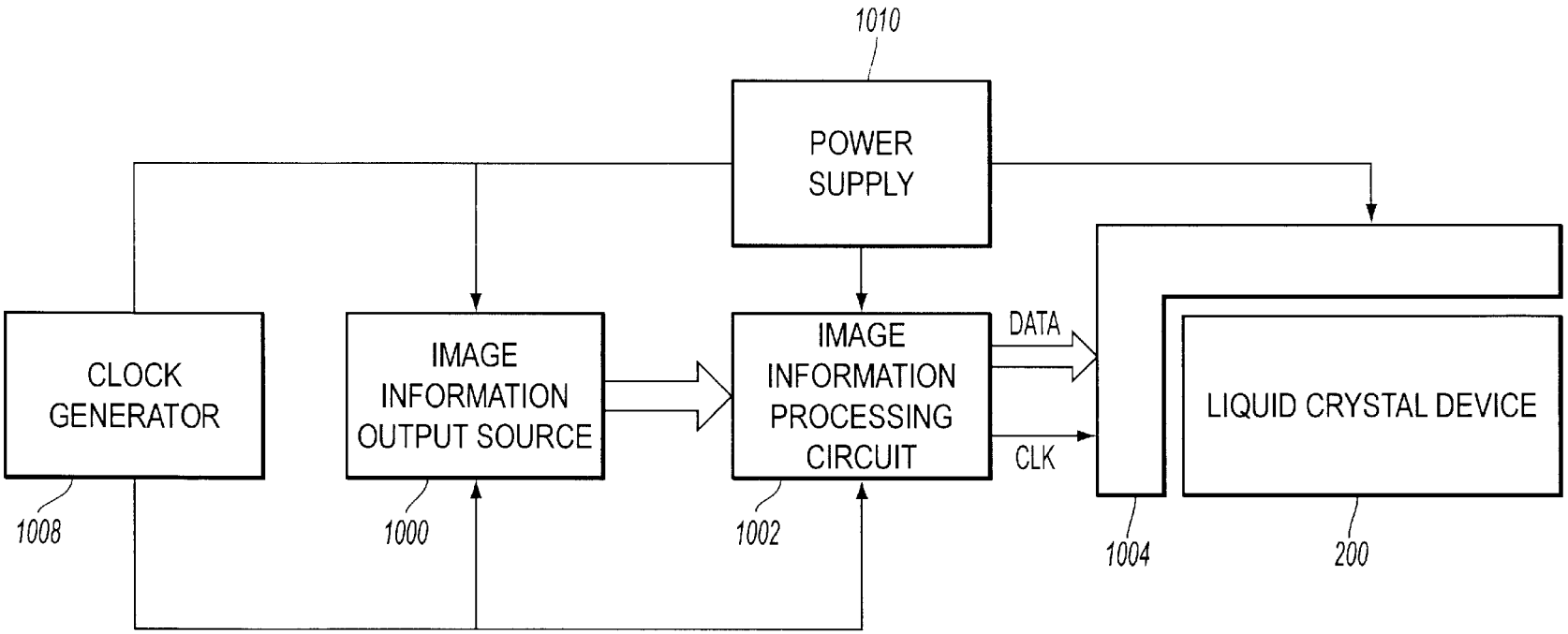
FIG. 16 is a block diagram illustrating a general structure of an electronic apparatus according to an embodiment of the invention.

FIG. 16 illustrates the general structure of an electronic apparatus including the liquid crystal device 200.

As shown in FIG. 16, the electronic apparatus includes an image information output source 1000, an image information processing circuit 1002, a driving circuit 1004 including a scanning line driving circuit 104 and a data line driving circuit 101 of the types described above, a liquid crystal device including a precharging circuit and a sampling circuit disposed under the light blocking frame as described earlier, a clock generator 1008, and a power supply 1010. The image information output source 1000 includes a memory such as a ROM (read only memory), a RAM (random access memory), or an optical disk and a tuning circuit. In response to the clock signal supplied from the clock generator 1008, the image information output source 1000 outputs image information such as an image signal to the image information processing circuit 1002. The image information processing circuit 1002 includes various processing circuits such as an inverting amplifier circuit, a phase expansion circuit, a rotation circuit, a gamma correction circuit, and a clamping circuit, which are all known in the art. The image information processing circuit 1002 successively generates a digital signal from the image information input in response to the clock signal, and outputs the resultant digital signal together with a clock signal CLK to the driving circuit 1004. The driving circuit 1004 drives the liquid crystal device 200 using the scanning line driving circuit 104 and the data line driving circuit 101 according to the above-described driving technique. The power supply 1010 supplies electric power to the various circuits described above. The driving circuit 1004 may be mounted on the TFT array substrate of the liquid crystal device 200. In addition, the image information processing circuit 1002 may also be mounted on the TFT array substrate.

Specific examples of electronic apparatus are described below with reference to FIGS. 17–19.

Figure 17:
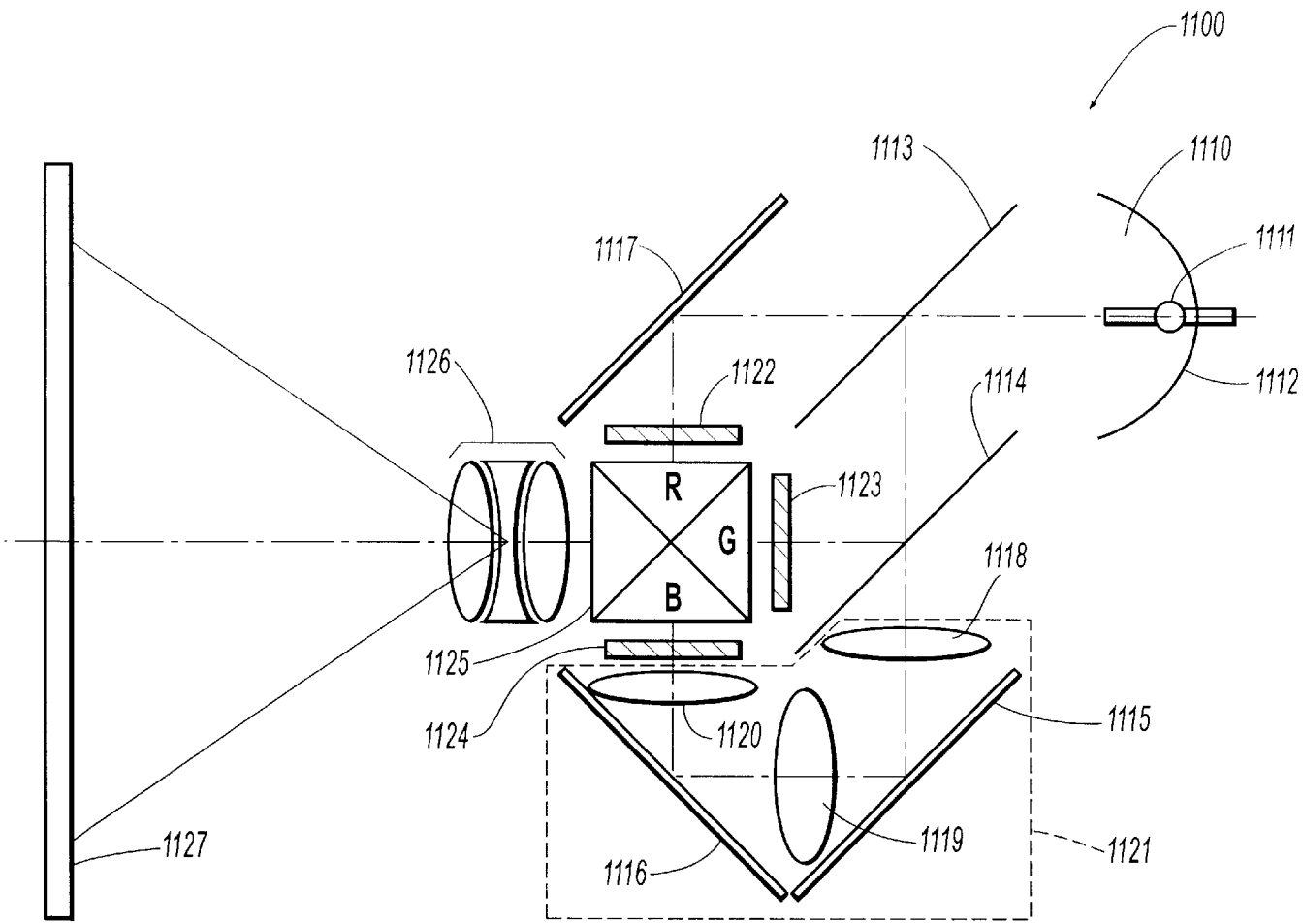
FIG. 17 is a cross-sectional view illustrating a liquid crystal projector which is an example of an electronic apparatus.

FIG. 17 illustrates an example of an electronic apparatus, that is, a projection type liquid crystal projector 1100 including a light source 1110, dichroic mirrors 1113 and 1114, reflecting mirrors 1115, 1116, and 1117, an incident lens 1118, a relay lens 1119, an emerging lens 1120, liquid crystal light valves 1122, 1123, and 1124, a cross dichroic prism 1125, and a projection lens 1126. The liquid crystal light valves 1122, 1123, and 1124 are realized by employing three liquid crystal devices 200 of the above-described type as liquid crystal light valves. The light source 1110 includes a lamp 1111 such as a metal halide: lamp and a reflector 1112 for reflecting light emitted from the lamp 1111.

In the liquid crystal projector 1110 having the above-described structure, the green light and blue light reflecting dichroic mirror 1113 transmits a red light beam of the white light beam emitted by the light source 1110 and reflects blue and green light beams. After passing through the dichroic mirror 1113, the red light beam is reflected by the reflecting mirror 1117 toward the red light liquid crystal valve 1122. On the other hand, of the light beams reflected by the dichroic mirror 1113, the green light beam is reflected by the green light reflecting dichroic mirror 1114 toward the green light liquid crystal light valve 1123. The blue light beam further passes through the second dichroic mirror 1114. In order to prevent the blue light beam from having a transmission loss caused by a long optical path, there is provided light guiding means 1121 consisting of a relay lens system including the incident lens 1118, the relay lens 1119, and the emerging lens 1120. The blue light beam falls, via this light guiding means 1121, on the blue light liquid crystal light valve 1124. Three color light beams are modulated by the respective light valves and the resultant three light beams are incident on the cross dichroic prism 1125. The cross dichroic prism 1125 is composed of four right-angle prisms which are bonded together wherein a dielectric multilayer film which reflects red light beams and a dielectric multilayer film which reflects blue light beams are disposed in a cross fashion at boundaries between adjacent prisms. These dielectric multilayer films cause the three color light beams to be mixed together and thus a light beam carrying color image information is obtained. The mixed light beam is projected onto a screen 1127 via the projection lens 1126 serving as a projection optical system so as to form an enlarged image on the screen.

Light valves realized with the liquid crystal devices according to the present invention produce no non-uniformity in contrast as described above, and thus they are very suitable for use in the liquid crystal projector of the type described above to obtain high quality display with no non-uniformity in contrast.

Figure 18:
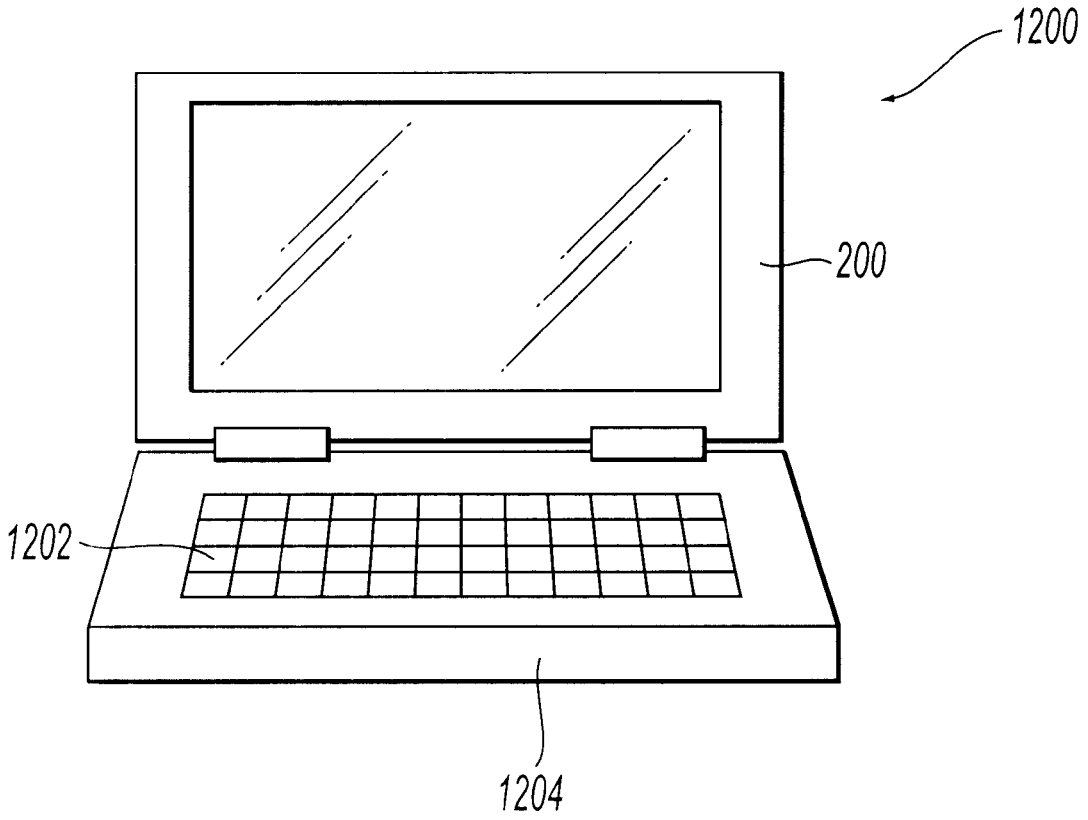
FIG. 18 is a front view illustrating a personal computer which is another example of an electronic apparatus.
Figure 19:
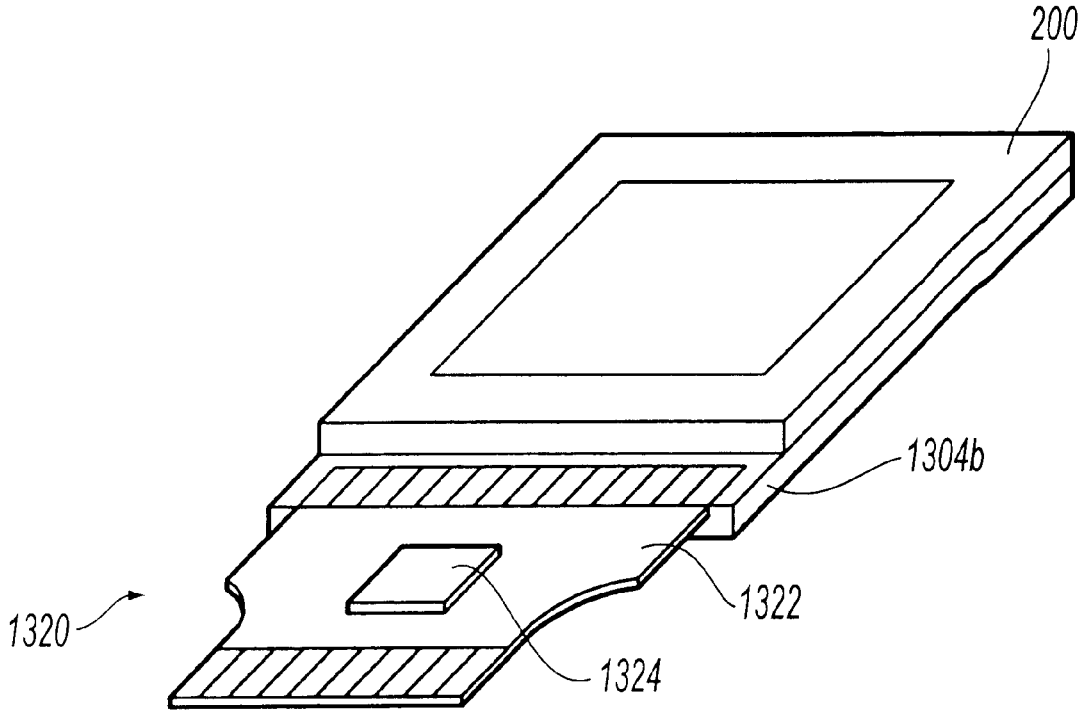
FIG. 19 is a perspective view illustrating a liquid crystal device using a TCP, which is still another example of an electronic apparatus.

FIG. 18 illustrates another example of an electronic apparatus, that is, a laptop personal computer 1200 including a liquid crystal device of the type described above disposed on the inner side of a top cover case. The main body 1204 of the laptop personal computer 1200 includes a CPU, a memory, a modem, and a keyboard 1202.

In the case where the driving circuit 1004 and the image information processing circuit 1002 are not mounted on the liquid crystal device, an IC 1324 including the driving circuit 1004 and the image information processing circuit 1002 may be mounted on a polyimide tape 1322 into the form of a TCP (tape carrier package) 1320, and the TCP 1320 may be connected electrically and physically to the TFT array substrate 1 via an anisotropic conductive film. The resultant assembly may be used or sold as a liquid crystal apparatus.

In addition to the electronic apparatus described above with reference to FIGS. 17–19, examples of the electronic apparatus shown in FIG. 6 include a liquid crystal television set, a video tape recorder with a viewfinder or a direct-view-type monitor, a car navigation apparatus, an electronic notepad, an electronic calculator, a word processor, a work station, a portable telephone, a video telephone, a POS terminal, and an apparatus with a touch panel.

According to the present embodiments, as described above, it is possible to realize various electronic apparatus using a liquid crystal apparatus 200 capable of displaying a high-quality image including no non-uniformity in contrast or color.

What is claimed is:

1. An electro-optical apparatus including a plurality of data lines for supplying an image signal, a plurality of scanning lines for supplying a scanning signal, first switching means being disposed in correspondence with intersections of the plurality of data lines and the plurality of scanning lines, and pixel electrodes being disposed in correspondence with the plurality of first switching means, said plurality of data lines, said plurality of scanning lines, said first switching means, and said pixel electrodes being all formed above a substrate, said electro-optical apparatus comprising:

a sampling circuit including second switching means for sampling said image signal supplied to an image signal line and supplying the resultant signal to said data lines; and a precharging circuit including third switching means for supplying a precharging signal supplied from a precharging signal line, to the data lines, according to a driving signal supplied from a precharging circuit driving signal line, before a sampling period in which the image signal is supplied to the data lines, the third switching means being disposed in correspondence with the data lines, the precharging signal line having a first end and a second end, electrically connected to the third switching means, the first end and the second end of the precharging signal line electrically connected to respective first and second external terminals to which the precharging signal is applied from an external circuit, the precharging signal lines extending over said substrate along a direction in arrangement with the third switching means and around at least two sides of the arrangement area of the plurality of data lines so that the precharging signal is applied from the first end and the second end of the precharging signal line via the first and second external terminals.

2. An electro-optical apparatus according to claim 1, said precharging signal lines being connected to different signal supplying contacts.

3. An electro-optical apparatus according to claim 1, the precharging signal lines being formed of a metal film or a metal alloy film having a low resistance similar to that of the data lines and formed in a same process in which the data lines are formed.

4. An electro-optical apparatus according to claim 1, the precharging circuit signal lines extending over said substrate along the direction in which the data lines are arranged side by side so that the precharging circuit signal lines are connected to said precharging circuit from two sides of the plurality of data lines.

5. An electro-optical apparatus according to claim 1, the electro-optical apparatus further comprising a data line driving circuit including a bidirectional shift register, the data line driving circuit successively driving the second switching means of the sampling circuit in the same or an opposite direction as to the direction in which the data lines are arranged side by side.

6. An electro-optical apparatus according to claim 1, said precharging circuit being disposed in the same side of the data lines together with a data line driving circuit including a shift register, and the sampling circuit, and the precharging circuit driving signal line being supplied with a precharging circuit driving signal to successively turn on the third switching means thereby successively driving the data lines before said second switching means is turned on.

7. An electro-optical apparatus according to claim 1, further comprising a data line driving circuit including a bidirectional shift register for successively driving said second switching means of the sampling circuit in the same or opposite direction as to the direction in which the data lines are arranged side by side; and a bidirectional shift register for successively driving said third switching means of the precharging circuit in the same or opposite direction as to the direction in which the data lines are arranged side by side.

8. An electro-optical apparatus according to claim 1, said precharging circuit being disposed on an opposite side of the data lines from said data line driving circuit and said sampling circuit, the third switching means comprising a plurality of transistors, the precharging circuit driving signal lines being supplied with a precharging circuit driving signal to turns on all of the plurality of transistors of the third switching means at the same time in a horizontal blanking period.

9. An electro-optical apparatus according to claims 1, said image singnal lines extending over said substrate along the direction in which the data lines are arranged side by side so as to be connected to said sampling circuit from two sides of the plurality of data lines.

10. An electronic apparatus including an electro-optical apparatus according to claim 1.

11. An electro-optical apparatus including a plurality of data lines for supplying an image signal, a plurality of scanning lines for supplying a scanning signal, first switching means being disposed in correspondence with intersections of the plurality of data lines and the plurality of scanning lines, and pixel electrodes being disposed in correspondence with the plurality of first switching means, said plurality of data lines, said plurality of scanning lines, said first switching means, and said pixel electrodes being all formed above a substrate, said electro-optical apparatus comprising:

a sampling circuit including second switching means for sampling said image signal supplied to an image signal line and supplying the resultant signal to said data lines; and a precharging circuit including third switching means for supplying a precharging signal, supplied to precharging signal lines, to said data lines according to a driving signal supplied from a precharging circuit driving signal line, before a sampling period in which said image signal is supplied to said data lines, the third switching means being disposed in correspondence with the data lines, the precharging circuit driving signal line having a first end and a second end electrically connected to the third switching means, the first end and the second end of the precharging circuit driving signal line electrically connected to respective first and second external terminals to which the precharging circuit driving signal is applied from an external circuit, the precharging circuit driving signal line extending over said substrate along a direction in arrangement with the third switching means and around at least two sides of the arrangement area of the plurality of data lines so that the precharging circuit driving signal is applied from the first end and the second end of the precharging circuit driving signal line via the first and second external terminals.

12. An electro-optical apparatus according to claim 11, said precharging circuit driving signal lines being connected to different signal supplying contacts.

13. An electro-optical apparatus according to claim 11, the precharging circuit driving signal lines being formed of a metal film or a metal alloy film having a low resistance similar to that of the data lines and formed in a same process in which the data lines are formed.

14. An electro-optical apparatus including a plurality of data lines for supplying an image signal, a plurality of scanning lines for supplying a scanning signal, first switching means being disposed in correspondence with intersections of the plurality of data lines and the plurality of scanning lines, and pixel electrodes being disposed in correspondence with the plurality of first switching means, said plurality of data lines, said plurality of scanning lines, said first switching means, and said pixel electrodes being all formed above a substrate, said electro-optical apparatus comprising:

a sampling circuit including second switching means for sampling said image signal supplied to an image signal line and supplying the resultant signal to said data lines, and the image signal line having a first end and a second end, electrically connected to the second switching means, the first end and the second end of the image signal line electrically connected to respective first and second external terminals to which the image signal is applied from an external circuit, the image signal lines extending over said substrate along a direction in arrangement with a data line driving circuit and around at least two sides of an arrangement area of the data line driving circuit so that the image signal is applied from the first end and the second end of the image signal line via the first and second external terminals.

15. An electro-optical apparatus according to claim 14, said image signal lines being connected to different signal supplying contacts.

16. An electro-optical apparatus according to claim 14, further comprising a data line driving circuit including a bidirectional shift register for successively driving said second switching means of the sampling circuit in the same or opposite direction as to the direction in which the data lines are arranged side by side.

17. An electro-optical apparatus including a plurality of data lines for supplying an image signal, a plurality of scanning lines for supplying scanning signals, first switching means being disposed in correspondence with intersections of the plurality of data lines and the plurality of scanning lines, and pixel electrodes being disposed in correspondence with the plurality of first switchingmeans, said plurality of scanning lines, said first switching means, and said pixel electrodes being formed above a substrate, said electro-optical apparatus comprising:

a sampling circuit including second switching means for sampling said image signal supplied to an image signal line and supplying the resultant signal to said data lines; and a precharging circuit including third switching means for supplying precharging signals supplied from precharging signal lines, to the data lines, according to a driving signal supplied from a precharging circuit driving signal line, before a sampling period in which the image signal is supplied to the data lines, the third switching means being disposed in correspondence with the data lines, the precharging signal line having a first end and a second end, extending along a direction in arrangement with the third switching means, the first end and the second end electrically connected to respective first and second external terminals, so that a precharging signal is applied from the first end and the second end of the precharging signal line via the first and second external terminals.

18. An electro-optical apparatus, comprising:

a plurality of data lines;

a plurality of scanning lines intersecting the plurality of data lines;

a plurality of first switching elements being disposed in correspondence with intersections of the plurality of data lines and the plurality of scanning lines;

a plurality of pixel electrodes being disposed in correspondence with the plurality of first switching elements;

a sampling circuit including a plurality of second switching elements for supplying an image signal to the plurality of data lines; and a precharging circuit including a plurality of third switching elements for supplying a precharging signal supplied from a precharging signal line, to the plurality of the data lines, according to a driving signal supplied from a precharging circuit, driving signal line, before a sampling period in which the image signal is supplied to the plurality of data lines, the precharging signal line being connected to the plurality of third switching elements, extending along a direction in arrangement with the third switching elements and around at least two sides in the arrangement area of the plurality of data lines so that the precharging signal is applied from the first end and the second end of the precharging signal line via the first and second external terminals.

19. An electro-optical apparatus, comprising:

a plurality of data lines;

a plurality of scanning lines intersecting the plurality of data lines;

a plurality of first switching elements being disposed in correspondence with intersections of the plurality of data lines and the plurality of scanning lines;

a plurality of pixel electrodes being disposed in correspondence with the plurality of first switching elements;

a sampling circuit including a plurality of second switching elements for supplying an image signal to the plurality of data lines; and a precharging circuit including a plurality of third switching elements for supplying a precharging signal supplied from a precharging circuit driving signal line, before a sampling period in which the image signal is supplied to the plurality of data lines, the precharging circuit driving signal line being connected to the plurality of third switching elements, extending along a direction in arrangement with the third switching elements and around at least two sides of the arrangement area of the plurality of data lines so that the precharging circuit driving signal is applied from the first end and the second end of the precharging circuit driving signal line via the first and second external terminals.

20. An electro-optical apparatus, comprising:

a plurality of data lines;

a plurality of scanning lines intersecting the plurality of data lines;

a plurality of first switching elements being disposed in correspondence with intersections of the plurality of data lines and the plurality of scanning lines;

a plurality of pixel electrodes being disposed in correspondence with the plurality of first switching elements;

a sampling circuit including a plurality of second switching elements for supplying an image signal to the plurality of data lines; and at least one of image signal lines being connected to the plurality of second switching elements, extending along a direction in arrangement with a data line driving circuit and around at least two sides of an arrangement area of the data line driving circuit so that the image signal is applied from the first end and the second end of the image signal line via the first and second external terminals.

21. An electro-optical apparatus, comprising:

a plurality of data lines;

a plurality of scanning lines intersecting the plurality of data lines;

a plurality of first switching elements being disposed in correspondence with intersections of the plurality of data lines and the plurality of scanning lines;

a plurality of pixel electrodes being disposed in correspondence with the plurality of first switching elements;

a sampling circuit including a plurality of second switching elements that supply an image signal to the plurality of data lines; and a precharging circuit including a plurality of third switching elements that supply a precharging signal supplied from a precharging signal line, to the plurality of the data lines, according to a driving signal supplied from a precharging circuit driving signal line, before a sampling period in which the image signal is supplied to the plurality of data lines, the precharging signal line being connected to the plurality of third switching elements, extending along a direction in arrangement with the third switching elements, the first end and the second end electrically connected to respective first and second external terminals so that the precharging signal is applied from the first end and the second end of the precharging signal line via the first and second external terminals.

* * * * *